US006184619B1

(12) United States Patent
Yamazaki et al.

(10) Patent No.: US 6,184,619 B1
(45) **Date of Patent: *Feb. 6, 2001**

(54) ELECTRON APPARATUS USING ELECTRON-EMITTING DEVICE AND IMAGE FORMING APPARATUS

(75) Inventors: Koji Yamazaki, Atsugi; Masahiro Fushimi, Zama; Hideaki Mitsutake, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/049,975

(22) Filed: Mar. 30, 1998

(30) Foreign Application Priority Data

Mar. 31, 1997 (JP) ..... 9-081280
Mar. 20, 1998 (JP) ..... 10-071859

(51) Int. Cl.[7] ..... H01J 1/62; H01J 1/88; H01J 29/70

(52) U.S. Cl. ..... 313/495; 313/292; 313/422

(58) Field of Search ..... 313/495, 496, 313/497, 422, 292, 336, 351, 355, 258; 445/24, 25

(56) References Cited

U.S. PATENT DOCUMENTS

| | | | |
|---|---|---|---|
| 4,904,895 | 2/1990 | Tsukamoto et al. | 313/336 |
| 4,973,888 | 11/1990 | Morimoto et al. | 315/366 |
| 5,066,883 | 11/1991 | Yoshioka et al. | 313/309 |
| 5,760,538 | 6/1998 | Mitsutake et al. | 313/422 |
| 5,859,502 | 1/1999 | Spindt, et al. | 315/169.3 |
| 5,898,266 | 4/1999 | Spindt, et al. | 313/495 |
| 5,936,343 * | 8/1999 | Fushimi et al. | 313/292 |

FOREIGN PATENT DOCUMENTS

| | | |
|---|---|---|
| 0 690 472 | 1/1996 | (EP) . |
| 0 739 029 | 10/1996 | (EP) . |
| 62-274047 | 11/1988 | (JP) . |
| 64-31332 | 2/1989 | (JP) . |
| 2-257551 | 10/1990 | (JP) . |
| 3-55738 | 3/1991 | (JP) . |
| 4-28137 | 1/1992 | (JP) . |

OTHER PUBLICATIONS

C.A. Mead, "Operation of Tunnel–Emission Devices," Journal of Applied Physics, vol. 32, No. 4, pp. 646–652 (Apr. 1961).

C.A. Spindt, et al., "Physical Properties of Thin–Film Field Emission Cathodes with Molybdenum Cones," Journal of Applied Physics, vol. 47, No. 12, pp. 5248–5263 (Dec. 1976).

W.P. Dyke, et al., "Field Emission," Advances in Electronics and Electron Physics, vol. VIII, pp. 89–185 (1956).

M.I. Elinson, et al., "The Emission of Hot Electrons and the Field Emission of Electrons From Tin Oxide," Radio Engineering and Electronic Physics, pp. 1290–1296 (Jul. 1965).

(List continued on next page.)

*Primary Examiner*—Nimeshkumar D. Patel
*Assistant Examiner*—Joseph Williams
(74) *Attorney, Agent, or Firm*—Fitzpatrick, Cella, Harper & Scinto

(57) ABSTRACT

An electron apparatus includes a rear substrate having an electron-emitting device, a front substrate irradiated with electrons, and a support member for maintaining the interval between these substrates. The distribution of the electric field is controlled, and a force acting in the direction away from the support member is applied to emitted electrons to prevent the electrons from striking the support member. At this time, the electrons are accelerated toward the front substrate. Since the degree of deflection by a deflection force on the rear substrate side is larger than the degree of deflection by a deflection force on the front substrate side, the deflection force on the rear substrate side is relatively weakened.

32 Claims, 26 Drawing Sheets

OTHER PUBLICATIONS

G. Dittmer, "Electrical Conduction and Electron Emission of Discontinuous Thin Films," Thin Solid Films, vol. 9, pp. 317–328 (1972).

M. Hartwell, et al., "Strong Electron Emission From Patterned Tin–Indium Oxide Thin Films," International Electron Devices Meeting, pp. 519–521 (1975).

H. Araki, et al., "Electroforming and Electron Emission of Carbon Thin Films," Journal of the Vacuum Society of Japan, vol. 26, No. 1, pp. 22–29 (1983).

R. Meyer, et al., "Recent Development on "Microtips" Display at LETI", Technical Digest of IVMC 91, pp. 6–9 (1991).

* cited by examiner

R : RED FLUORESCENT SUBSTANCE
G : GREEN FLUORESCENT SUBSTANCE
B : BLUE FLUORESCENT SUBSTANCE

R : RED FLUORESCENT SUBSTANCE
G : GREEN FLUORESCENT SUBSTANCE
B : BLUE FLUORESCENT SUBSTANCE

ELECTRON APPARATUS USING ELECTRON-EMITTING DEVICE AND IMAGE FORMING APPARATUS

BACKGROUND OF THE INVENTION

1. Field of the Invention

The present invention relates to an electron apparatus associated with electron emission and, more particularly, to an image forming apparatus for forming an image by electrons.

2. Description of the Related Art

Conventionally, two types of devices, namely hot and cold cathode devices, are known as electron-emitting devices. Known examples of the cold cathode devices are surface-conduction emission (SCE) type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio Eng. Electron Phys., 10, 1290 (1965) and other examples will be described later.

The surface-conduction emission type electron-emitting device utilizes the phenomenon that electrons are emitted from a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 19 is a plan view showing the surface-conduction emission type electron-emitting device by M. Hartwell et al. described above as a typical example of the device structures of these surface-conduction emission type electron-emitting devices. Referring to FIG. 19, numeral 3001 denotes a substrate; and 3004, a conductive thin film made of a metal oxide formed by sputtering. This conductive thin film 3004 has an H-shaped pattern, as shown in FIG. 19. An electron-emitting portion 3005 is formed by performing electrification processing (referred to as forming processing to be described later) with respect to the conductive thin film 3004. An interval L in FIG. 19 is set to 0.5 to 1 mm, and a width W is set to 0.1 mm. The electron-emitting portion 3005 is shown in FIG. 19 in a rectangular shape at almost the center of the conductive thin film 3004 for the sake of illustrative convenience. However, this does not exactly show the actual position and shape of the electron-emitting portion 3005.

In the above surface-conduction emission type electron-emitting devices by M. Hartwell et al. and the like, typically the electron-emitting portion 3005 is formed by performing electrification processing called energization forming processing for the conductive thin film 3004 before electron emission. That is, the forming processing is to form an electron-emitting portion by electrification. For example, a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

FIG. 20 is a cross-sectional view showing a typical example of the FE type device structure (device by C. A. Spindt et al. described above). Referring to FIG. 20, numeral 3010 denotes a substrate; 3011, an emitter wiring layer made of a conductive material; 3012, an emitter cone; 3013, an insulating layer; and 3014, a gate electrode. In this device, a voltage is applied between the emitter cone 3012 and the gate electrode 3014 to emit electrons from the distal end portion of the emitter cone 3012.

As another FE type device structure, there is an example in which an emitter and a gate electrode are arranged on a substrate to be almost parallel to the surface of the substrate, in addition to the multilayered structure of FIG. 20.

A known example of the MIM type electron-emitting devices is described in C. A. Mead, "Operation of Tunnel-Emission Devices", J. Appl. Phys., 32,646 (1961). FIG. 21 shows a typical example of the MIM type device structure. FIG. 21 is a cross-sectional view of the MIM type electron-emitting device. Referring to FIG. 21, numeral 3020 denotes a substrate; 3021, a lower electrode made of a metal; 3022, a thin insulating layer having a thickness of about 100 A; and 3023, an upper electrode made of a metal and having a thickness of about 80 to 300 A. In the MIM type electron-emitting device, an appropriate voltage is applied between the upper electrode 3023 and the lower electrode 3021 to emit electrons from the surface of the upper electrode 3023.

Since the above-described cold cathode devices can emit electrons at a temperature lower than that for hot cathode devices, they do not require any heater. The cold cathode device therefore has a structure simpler than that of the hot cathode device and can be micropatterned. Even if a large number of devices are arranged on a substrate at a high density, problems such as heat fusion of the substrate hardly arise. In addition, the response speed of the cold cathode device is high, while the response speed of the hot cathode device is low because it operates upon heating by a heater.

For this reason, applications of the cold cathode devices have enthusiastically been studied.

Of cold cathode devices, the above surface-conduction emission type electron-emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied. Regarding applications of surface-conduction emission type electron-emitting devices to, e.g., image forming apparatuses such as an image display apparatus and an image recording apparatus, electron-beam sources, and the like have been studied.

As an application to image display apparatuses, in particular, as disclosed in the U.S. Pat. No. 5,066,833 and Japanese Patent Laid-Open Nos. 2-257551 and 4-28137 filed by the present applicant, an image display apparatus using the combination of an surface-conduction emission type electron-emitting device and a fluorescent substance which emits light upon reception of an electron beam has been studied. This type of image display apparatus using the combination of the surface-conduction emission type electron-emitting device and the fluorescent substance is expected to have more excellent characteristics than other conventional image display apparatuses. For example, in comparison with recent popular liquid crystal display apparatuses, the above display apparatus is superior in that it does not require a backlight because it is of a self-emission type and that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat display apparatus reported by R. Meyer et al. [R. Meyer: "Recent Development on Microtips Display at LETI", Tech. Digest of 4th Int. Vacuum Microelectronics Conf., Nagahama, pp. 6–9 (1991)].

An example of an application of a larger number of MIM type electron-emitting devices arranged side by side to an image display apparatus is disclosed in Japanese Patent Laid-Open No. 3-55738 filed by the present applicant.

Of image display apparatuses using electron-emitting devices like the ones described above, a thin, flat display apparatus receives a great deal of attention as an alternative to a CRT (Cathode-Ray Tube) display apparatus because of a small space and light weight.

FIG. 22 is a perspective view of an example of a display panel for a flat image display apparatus where a portion of the panel is removed for showing the internal structure of the panel.

In FIG. 22, numeral 3115 denotes a rear plate; 3116, a side wall; and 3117, a face plate. The rear plate 3115, the side wall 3116, and the face plate 3117 form an envelope (airtight container) for maintaining the inside of the display panel vacuum.

The rear plate 3115 has a substrate 3111 fixed thereto, on which N×M cold cathode devices 3112 are provided (M, N=positive integer equal to "2" or greater, appropriately set in accordance with an object number of display pixels). As shown in FIG. 23, the N×M cold cathode devices 3112 are arranged with M row-direction wirings 3113 and N column-direction wirings 3114. The portion constituted with the substrate 3111, the cold cathode devices 3112, the row-direction wiring 3113, and the column-direction wiring 3114 will be referred to as "multi electron-beam source". At an intersection of the row-direction wiring 3113 and the column-direction wiring 3114, an insulating layer (not shown) is formed between the wirings, to maintain electrical insulation.

Further, a fluorescent film 3118 made of a fluorescent substance is formed under the face plate 3117. The fluorescent film 3118 is colored with red, green and blue, three primary color fluorescent substances (not shown). Black conductive material (not shown) is provided between the fluorescent substances constituting the fluorescent film 3118. Further, a metal back 3119 made of Al or the like is provided on the surface of the fluorescent film 3118 on the rear plate 3115 side.

In FIG. 22, symbols Dx1 to Dxm, Dy1 to Dyn, and Hv denote electric connection terminals for airtight structure provided for electrical connection of the display panel with an electric circuit (not shown). The terminals Dx1 to Dxm are electrically connected to the row-direction wiring 3113 of the multi electron-beam source; Dy1 to Dyn, to the column-direction wiring 3114; and Hv, to the metal back 3119.

The inside of the airtight container is exhausted at about $10^{-6}$ Torr. As the display area of the image display apparatus becomes larger, the image display apparatus requires a means for preventing deformation or damage of the rear plate 3115 and the face plate 3117 caused by a difference in pressure between the inside and outside of the airtight container. If the deformation or damage is prevented by heating the rear plate 3115 and the face plate 3117, not only the weight of the image display apparatus increases, but also image distortion and parallax are caused when the user views the image from an oblique direction. To the contrary, in FIG. 22, the display panel comprises a structure support member (called a spacer or rib) 3120 made of a relatively thin glass to resist the atmospheric pressure. With this structure, the interval between the substrate 3111 on which the multi beam-electron source is formed, and the face plate 3117 on which the fluorescent film 3118 is formed is normally kept at submillimeters to several millimeters. As described above, the inside of the airtight container is maintained at high vacuum.

In the image display apparatus using the above-described display panel, when a voltage is applied to the cold cathode devices 3112 via the outer terminals Dx1 to Dxm and Dy1 to Dyn, electrons are emitted by the cold cathode devices 3112. At the same time, a high voltage of several hundreds V to several kV is applied to the metal back 3119 via the outer terminal Hv to accelerate the emitted electrons and cause them to collide with the inner surface of the face plate 3117. Consequently, the respective fluorescent substances constituting the fluorescent film 3118 are excited to emit light, thereby displaying an image.

The above-mentioned electron beam apparatus of the image forming apparatus or the like comprises an envelope for maintaining vacuum inside the apparatus, an electron source arranged inside the envelope, a target on which an electron beam emitted by the electron source is irradiated, an acceleration electrode for accelerating the electron beam toward the target, and the like. In addition to them, a support member (spacer) for supporting the envelope from its inside against the atmospheric pressure applied to the envelope is arranged inside the envelope.

The display panel of this image display apparatus suffers the following problem.

Some of electrons emitted near the spacer strike the spacer, or ions produced by the action of emitted electrons attach to the spacer. Further, some of electrons which have reached the face plate are reflected and scattered, and some of the scattered electrons strike the spacer to charge the spacer. The orbits of electrons emitted by the cold cathode devices are changed by the charge-up of the spacer, and the electrons landing positions different from proper positions on the fluorescent substances. As a result, a distorted image is displayed near the spacer.

To solve this problem, the charge-up of the spacer is eliminated (to be referred to as charge-up elimination hereinafter) by flowing a small current through the spacer. In this case, a high-resistance film is formed on the surface of an insulating spacer to flow a small current through the surface of the spacer. The high-resistance film used is a tin oxide film, a mixed-crystal thin film of tin oxide and indium oxide, an island-like metal film, or the like.

As the number of emitted electrons by cold cathode devices increases, the charge-up elimination ability becomes poorer, and the charge-up amount depends on the intensity of an electron beam. Along with this, an electron beam emitted by a device near the spacer shifts from a proper position on the target depending on the intensity (luminance) of the electron beam. For example, in displaying a moving image, the image fluctuates.

SUMMARY OF THE INVENTION

It is an object of the present invention to provide a new structure including a support member near the support member.

The first aspect of an electron apparatus according to the present invention has the following arrangement.

An electron apparatus comprising a rear substrate having an electron-emitting device, a front substrate having a member to be irradiated with electrons, and a support member for maintaining an interval between the rear substrate and the front substrate is characterized in that an electric field for accelerating electrons from the rear substrate toward the front substrate is applied, a surface of the support member has a first region with a length d1 from a portion connected to the rear substrate and a resistance R1 per unit length in a longitudinal direction, a third region with a length d3 from a portion connected to the front substrate and a resistance R3 per unit length in the longitudinal direction, and a second region which is sandwiched between the first and third regions and has a resistance R2 per unit length in the longitudinal direction, both R1 and R3 are lower than R2, and the lengths and resistances of the first and third regions satisfy at least either one of the following conditions:

a) $d1<d3$ b) $R1>R3$

In the first aspect, by setting the resistance of the first region per unit length on the rear substrate side to be lower than the resistance of the second region per unit length, a force acting in the direction away from the support member can be applied to electrons emitted by the electron-emitting device. More specifically, if the resistance of the first region per unit length is set lower than the resistance of the second region per unit length, the electric field for accelerating the electrons allows the normal line of its equipotential plane near the connected portion between the support member and the rear substrate to have a component in the direction away from the support member. Accordingly, the electrons receive the force in the direction away from the support member. Particularly in the first aspect, deflection of the electrons is preferably controlled by satisfying at least either one of conditions a) and b). More specifically, the structure satisfying condition a) is compared with the structure satisfying $d1 \geqq d3$ while the remaining requirements are kept unchanged. As a result, the structure satisfying condition a) is smaller in shift amount of the actual irradiation point of the electron from the point of projection from the electron-emitting device on the electron irradiation surface of the front substrate. In addition, the structure satisfying condition b) is compared with the structure satisfying $R1 \leqq R3$ while the remaining requirements are kept unchanged. As a result, the structure satisfying condition b) is smaller in shift amount of the actual irradiation point of the electron from the point of projection from the electron-emitting device on the electron irradiation surface of the front substrate. This is because the speed of the electron near the front substrate is higher than that near the rear substrate, so that the influence of deflection on the shift amount of the actual irradiation point of the electron from the point of projection from the electron-emitting device on the electron irradiation surface of the front substrate is greater in the first region than in the third region. Therefore, this shift amount can be suppressed by setting the deflection force in the first region or/and the distance to apply the force to be smaller than the deflection force in the third region or/and the distance to apply the force. Further, the structure satisfying $R1 \leqq R3$ and $d1 \geqq d3$ is compared with the structure satisfying $d1<d3$ while the remaining requirements are kept unchanged. As a result, the shift amount is smaller in the structure satisfying $d1<d3$. The structure satisfying $R1 \leqq R3$ and $d1 \geqq d3$ is compared with the $R1>R3$ while the remaining requirements are kept unchanged. As a result, the shift amount is smaller in the structure satisfying $R1>R3$. From these results, the electron apparatus can employ various structures satisfying at least either one of conditions a) and b).

When R1 and R3 are sufficiently lower than R2, the end portion of the first region on the second region side is regarded to have the same potential as that of the portion of the first region which is connected to the rear substrate, and the end portion of the third region on the second region side is regarded to have the same potential as that of the portion of the third region which is connected to the front substrate, deflection can be more easily applied in the third region than in the first region by setting $d3>d1$.

The second aspect of the electron apparatus according to the present invention has the following arrangement.

An electron apparatus comprising a rear substrate having an electron-emitting device, a front substrate having a member to be irradiated with electrons, and a support member for maintaining an interval between the rear substrate and the front substrate is characterized in that an electric field for accelerating electrons from the rear substrate toward the front substrate is applied, a surface of the support member has a first region with a length d1 from a portion connected to the rear substrate, a third region with a length d3 from a portion connected to the front substrate, and a second region sandwiched between the first and third regions, potential differences per unit length in a longitudinal direction on the surface of the support member in the first and third regions are smaller than a potential difference per unit length in the longitudinal direction on the surface of the support member in the second region, and letting $\Delta V1$ be a potential difference between a potential of a portion connected to the rear substrate and a potential of a portion of the first region on the second region side, and $\Delta V3$ be a potential different between a potential of a portion connected to the front substrate and a potential of a portion of the third region on the second region side, the potential differences satisfy:

$\Delta V1/d1>\Delta V3/d3$

In this structure, the potential differences per unit length in the longitudinal direction on the surface of the support member in the first and third regions are smaller than the potential difference per unit length in the longitudinal direction on the surface of the support member in the second region. For this reason, the electrons receive a force in the direction away from the support member in the first region, and a force in the direction toward the support member in the third region. If the first and third regions of the support member have different potential differences per unit length, and the potential difference per unit length in the third region is particularly set smaller than the potential difference per unit length in the first region, a force larger than deflection in the first region near the rear substrate is applied to the electrons near the front substrate where the electrons are accelerated and hardly deflected.

In the respective aspects described above, to relax charge-up in third region, the third region desirably extends from the portion connected to the front substrate where charge-up most easily occurs, to the position corresponding to 1/10 or more of the distance between the front substrate and the rear substrate.

In the respective aspects described above, a member having a higher conductivity than a conductivity of a surface of the second region may be exposed on a surface of the first or third region. Various members are available as the member having a higher conductivity than the conductivity of the surface of the second region. This higher-conductivity member can adopt various structures, and is a film formed on the surface of the first or third region or a member having the surface and interior almost uniform.

As a concrete example of the structure in the respective aspects described above, the second region is also made conductive, and a current is flowed between the front substrate and the rear substrate to relax the charge-up of the support member. To give the second region desired conductivity, a conductive film may be formed as the second region on the surface of the support member. In particular, when a member having high insulating properties is used as a substrate for the support member, a conductive film is effectively formed on the surface of the insulating member. A proper sheet resistance of the support member is $10^6$ to $10^{12}$ Ω.

In the respective aspects described above, to decrease the probability of unwanted discharge, a potential difference between a potential of an end portion of the first region on the second region side and a potential of an end portion of the third region on the second region side, and an interval between the end portion of the first region on the second region side and the end portion of the third region on the second region side have a relationship of not more than 8 kV/mm, and more preferably not more than 4 kV/mm.

In the respective aspects described above, the support member is desirably connected to the rear substrate or the front substrate via wiring or an electrode. In arranging a member serving as the support member after wiring or an electrode is formed on the rear or front substrate, a conductor is formed at an abutment portion against the wiring or electrode formed on the substrate in advance. This structure can realize electrically good connection. It is also preferable to arrange an acceleration electrode on the front substrate side in order to apply the electric field for accelerating the electrons from the rear substrate toward the front substrate. The support member is desirably electrically connected to the acceleration electrode on the front substrate side.

In the respective aspects described above, the electron-emitting device is a cold cathode type electron-emitting device or a surface-conduction emission type electron-emitting device. The electron apparatus may comprise a plurality of electron-emitting devices.

The first aspect of an image forming apparatus according to the present invention has the following arrangement.

An image forming apparatus using any one of the electron apparatuses described above is characterized in that an image is formed on the member to be irradiated with electrons.

The second aspect of the image forming apparatus according to the present invention has the following arrangement.

An image forming apparatus using any one of the electron apparatuses described above is characterized in that the member to be irradiated with electrons has a light-emitting substance which emits light upon irradiation of electrons.

In the image forming apparatus, the light-emitting substance may be a fluorescent substance.

The present invention will be described in more detail with reference to FIG. 1. Numeral 30 denotes a face plate (face substrate) including fluorescent substances and a metal back; 31, a rear plate (rear substrate) including an electron source substrate; 50, a main body for the spacer; 51, a high-resistance film on the surface of the spacer; 52, an electrode (intermediate layer) on the side surface of the spacer in contact with the face plate; 53, an electrode (intermediate layer) on the side surface of the spacer in contact with the rear plate; and 13, device driving wiring. These parts 50, 51, 52, 53, and 13 constitute the support member (frits (not shown in FIG. 1) are also a constituent element of the support member when the intermediate layer 52 and the face plate 30, and the intermediate layer 53 and the rear plate 31 (i.e., the intermediate layer 53 and the wiring 13) are respectively connected via the frits). Numeral 111 denotes a device; 112, typical electron beam orbits; and 25, equipotential lines. Symbol a denotes a length of the third region (length of the region having a resistivity R3) corresponding to the distance from the lower surface of the face plate to the lower end of the intermediate layer 52; and b, a length of the first region (length of the region having a resistivity R1) corresponding to the distance from the upper surface of the rear plate 31 to the upper end of the intermediate layer 53.

To prevent the charge-up of the spacer, the resistance of the high-resistance film serving as a charge-up prevention film may be decreased. This however leads to an increase in power consumption and generation of heat. For this reason, by controlling the potential gradient near the spacer without decreasing the resistance of the high-resistance film, the beam is controlled. More specifically, the beam is temporarily moved apart from the spacer by the electrode 53 of the spacer on the electron source substrate side. Then, the beam is caused to return to a proper position by the electrode 52 on the side surface of the spacer in contact with the face plate. At this time, the space near the spacer has a potential distribution indicated by the equipotential lines 25. Since the beam is more accelerated nearer the face plate 30, the electrode 52 on the side surface of the spacer in contact with the face plate must be made longer than the electrode 53 on the side surface of the spacer in contact with the electron source substrate, and the potential gradient on the face plate side must be made steep.

When no electron beam directly strikes the spacer, the charge-up of the spacer near the face plate is large. Variations in charge-up amount are considered to most influence fluctuation of the beam. For this reason, the electrode 52 on the side surface of the spacer in contact with the face plate is formed to cover this charge-up region. Accordingly, the dependency of the beam landing position of the face plate on the electron emission amount can be reduced.

The electron apparatus of the present invention has the following forms.

1̂ The cold cathode device is a cold cathode device having a conductive film including an electron-emitting portion between a pair of electrodes, and preferably a surface-conduction emission type electron-emitting device.

2̂ The electron source is an electron source having a simple matrix layout in which a plurality of cold cathode devices are wired in a matrix by a plurality of row-direction wirings and a plurality of column-direction wirings.

3̂ The electron source is an electron source having a ladder-shaped layout in which a plurality of rows (to be referred to as a row direction hereinafter) of a plurality of cold cathode devices arranged parallel and connected at two terminals of each device are arranged, and a control electrode (to be referred to as a grid hereinafter) arranged above the cold cathode devices along the direction (to be referred to as a column direction hereinafter) perpendicular to this wiring controls electrons emitted by the cold cathode devices.

4 According to the concepts of the present invention, the present invention is not limited to an image forming apparatus suitable for display. The above-mentioned image forming apparatus can also be used as a light-emitting source instead of a light-emitting diode for an optical printer made up of a photosensitive drum, the light-emitting diode, and the like. At this time, by properly selecting m row-direction wirings and n column-direction wirings, the image forming apparatus can be applied as not only a linear light-emitting source but also a two-dimensional light-emitting source. In this case, the image forming member is not limited to a substance which directly emits light, such as a fluorescent substance used in embodiments (to be described below), but may be a member on which a latent image is formed by charging of electrons.

Other features and advantages of the present invention will be apparent from the following description take in conjunction with the accompanying drawings, in which like reference characters designate the same or similar parts throughout the figures thereof.

DETAILED DESCRIPTION OF THE PREFERRED EMBODIMENTS

An embodiment of the present invention will be described in detail below with reference to the accompanying drawings.

General Description of Image Display Apparatus

First, the construction of a display panel of an image display apparatus to which the present invention is applied and a method for manufacturing the display panel will be described below.

Figure 13:
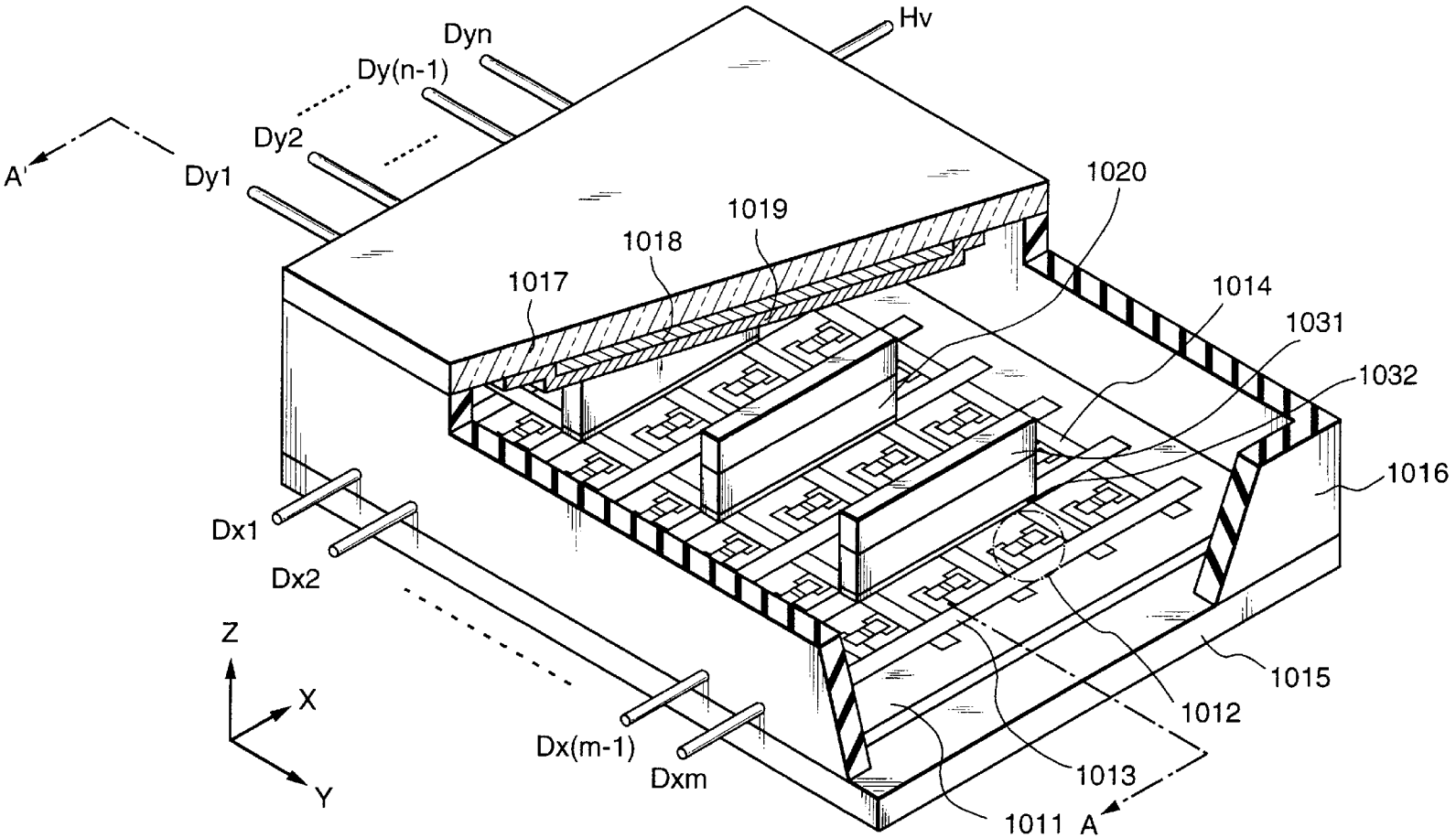
FIG. 13 is a partially cutaway perspective view showing the display panel of the image display apparatus in the embodiment.

FIG. 13 is a perspective view of the display panel where a portion of the panel is removed for showing the internal structure of the panel.

In FIG. 13, numeral 1015 denotes a rear plate; 1016, a side wall; and 1017, a face plate. These parts form an airtight container for maintaining the inside of the display panel vacuum. To construct the airtight container, it is necessary to seal-connect the respective parts to obtain sufficient strength and maintain airtight condition. For example, a frit glass is applied to junction portions, and sintered at 400 to 500° C. in air or nitrogen atmosphere, thus the parts are seal-connected. A method for exhausting air from the inside of the container will be described later. Since the inside of the airtight container is kept exhausted at about $10^{-6}$ Torr, a spacer 1020 having an intermediate layer 1031 on the face plate side and an intermediate layer 1032 on the rear plate side is arranged as a structure resistant to the atmospheric pressure in order to prevent damage of the airtight container caused by the atmospheric pressure or sudden shock.

The rear plate 1005 has a substrate 1011 fixed there, on which N×M cold cathode devices 1012 are provided (M, N=positive integer equal to "2" or greater, appropriately set in accordance with an object number of display pixels. For example, in a display apparatus for high-quality television display, desirably N=3000 or greater, M=1000 or greater. In this embodiment, N=3072, M=1024.). The N×M cold cathode devices 3112 are arranged with M row-direction wirings 1013 and N column-direction wirings 1014. The portion constituted with these parts 1011 to 1014 will be referred to as "multi electron-beam source".

In the multi electron-beam source used in the image display apparatus of the present invention, the material, shape, and manufacturing method of the cold cathode device are not limited as far as an electron source is prepared by wiring cold cathode devices in a simple matrix. Therefore, the multi electron-beam source can employ a surface-conduction emission (SCE) type electron-emitting device or an FE type or MIM type cold cathode device.

The structure of the multi electron-beam source prepared by arranging SCE type electron-emitting devices (to be described later) as cold cathode devices on a substrate and wiring them in a simple matrix will be described.

Figure 15:
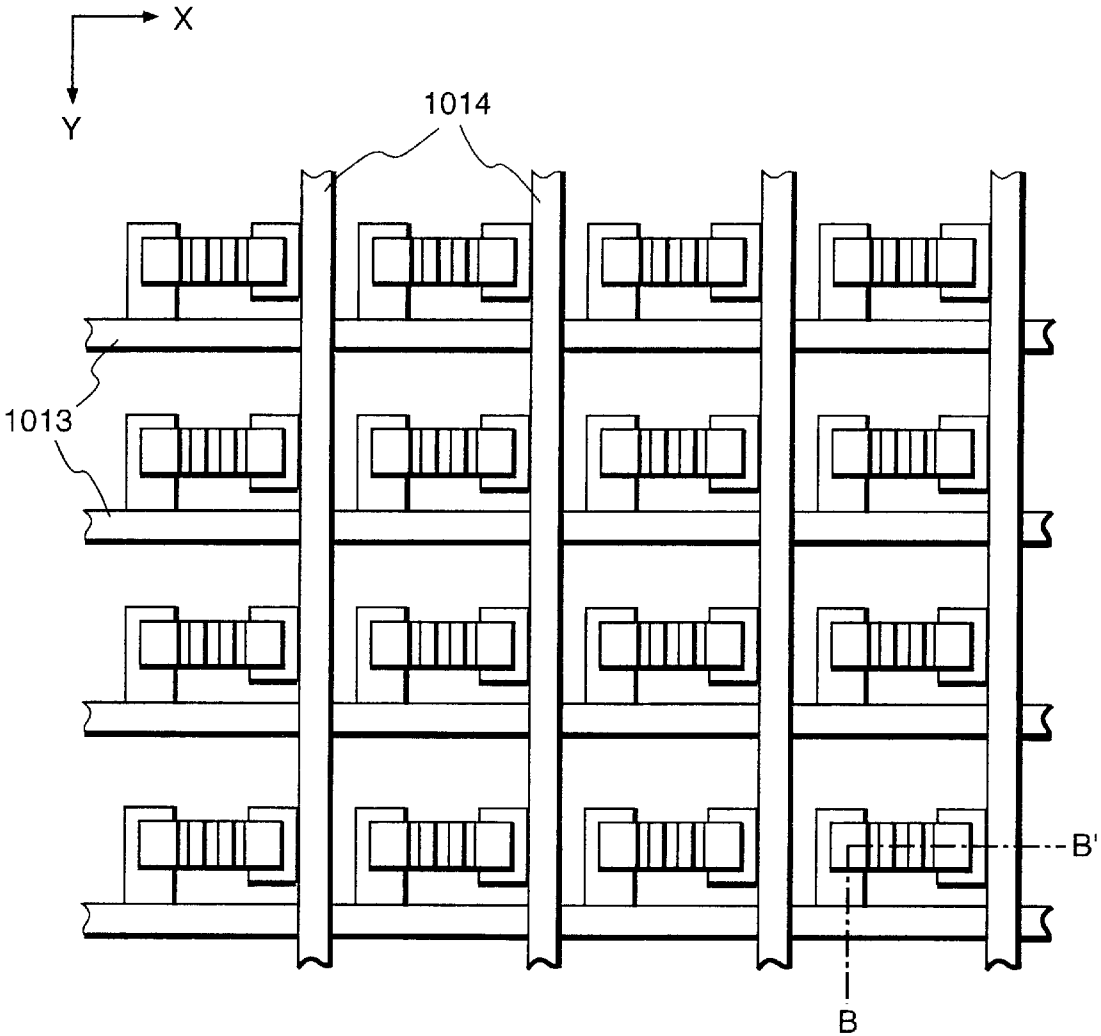
FIG. 15 is a partial plan view of the substrate of the multi electron-beam source used in the embodiment.

FIG. 15 is a plan view of a multi electron-beam source used in the display panel in FIG. 13. SCE type electron-emitting devices like the one shown in FIGS. 6A and 6B (to be described later) are arranged on the substrate 1011. These devices are wired in a simple matrix by the row-direction wiring electrodes 1013 and the column-direction wiring electrodes 1014. At an intersection of each row-direction wiring electrode 1013 and the column-direction wiring electrode 1014, an insulating layer (not shown) is formed between the electrodes to maintain electrical insulation.

Figure 16:
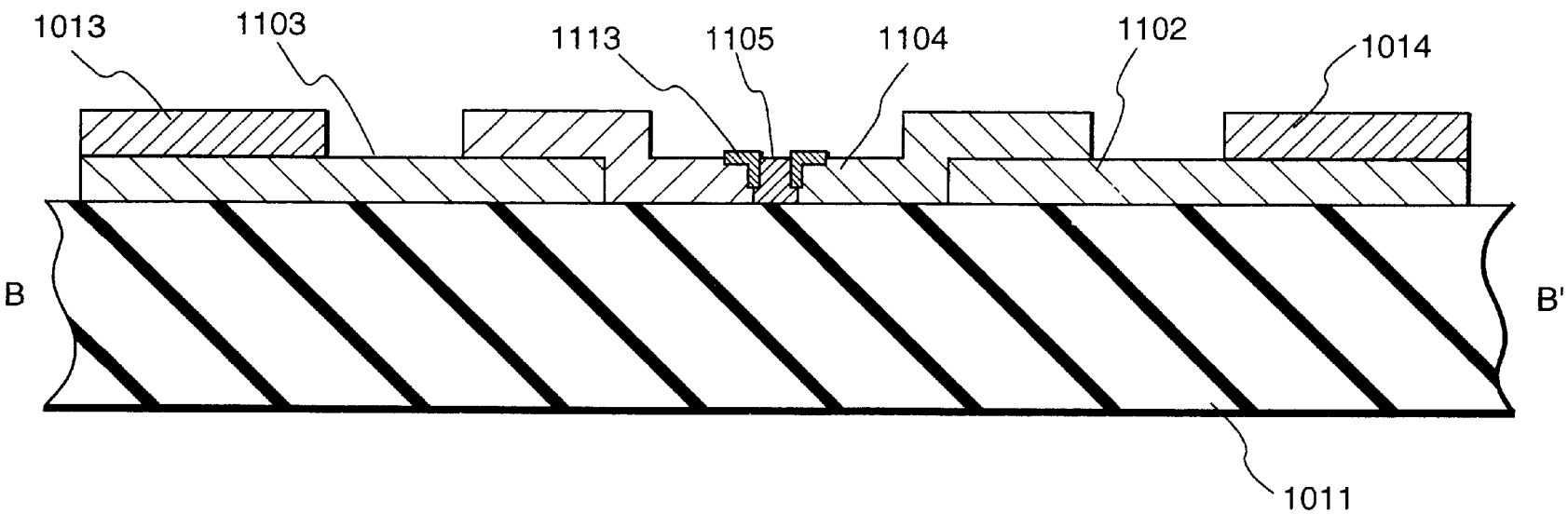
FIG. 16 is across-sectional view cut out along the line B–B' in FIG. 15.

FIG. 16 shows a cross-section cut out along the line B–B' in FIG. 15.

A multi electron-beam source having this structure is manufactured by forming the row-direction wiring electrodes 1013, the column-direction wiring electrodes 1014, an electrode insulating film (not shown), and device electrodes and conductive thin films of SCE type electron-emitting devices on the substrate in advance, and then supplying electricity to the devices via the row-direction wiring electrodes 1013 and the column-direction wiring electrodes 1014 to perform forming processing and activation processing (both of which will be described later).

In this embodiment, the substrate 1011 of the multi electron-beam source is fixed to the rear plate 1015 of the airtight container. However, if the substrate 1011 has sufficient strength, the substrate 1011 of the multi electron-beam source itself may be used as the rear plate of the airtight container.

Figure 5A:
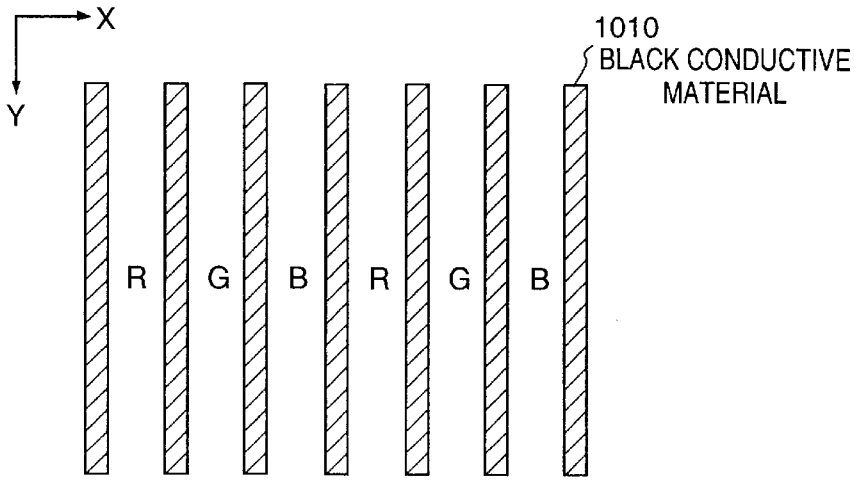
FIGS. 5A and 5B are plan views showing other examples of the alignment of the fluorescent substances on the face plate of a display panel.

Further, a fluorescent film 1018 is formed under the face plate 1017. As this embodiment is a color display apparatus, the fluorescent film 1018 is colored with red, green and blue three primary color fluorescent substances. The fluorescent substance portions are in stripes as shown in FIG. 5A, and black conductive material 1010 is provided between the stripes. The object of providing the black conductive material 1010 is to prevent shifting of display color even if electron-beam irradiation position is shifted to some extent, to prevent degradation of display contrast by shutting off reflection of external light, to prevent charge-up of the fluorescent film by electron beams, and the like. The black conductive material 1010 mainly comprises graphite, however, any other materials may be employed so far as the above object can be attained.

Figure 5B:
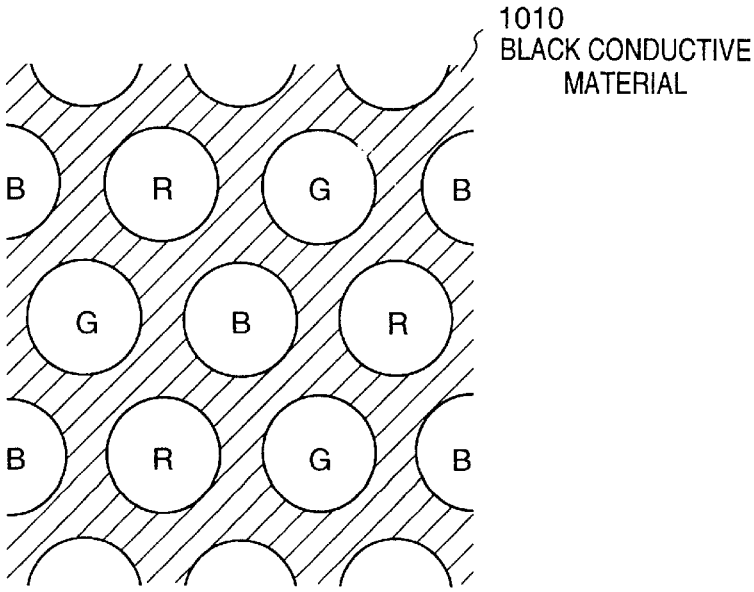

Further, three-primary colors of the fluorescent film is not limited to the stripes as shown in FIG. 5A. For example, delta arrangement as shown in FIG. 5B or any other arrangement may be employed.

Note that when a monochrome display panel is formed, a single-color fluorescent substance may be applied to the fluorescent film 1018, and the black conductive material may be omitted.

Further, a metal back 1019, which is well-known in the CRT field, is provided on the rear plate side surface of the fluorescent film 1018. The object of providing the metal back 1019 is to improve light-utilization ratio by mirror-reflecting a part of light emitted from the fluorescent film 1018, to protect the fluorescent film 1018 from collision between negative ions, to use the metal back 1019 as an electrode for applying an electron-beam accelerating voltage, to use the metal back 1019 as a conductive path for electrons which excited the fluorescent film 1018, and the like. The metal back 1019 is formed by, after forming the fluorescent film 1018 on the face plate 1017, smoothing the fluorescent film front surface, and vacuum-evaporating Al thereon. Note that in a case where the fluorescent film 1018 comprises fluorescent material for low voltage, the metal back 1019 is not used.

Further, for application of accelerating voltage or improvement of conductivity of the fluorescent film, transparent electrodes made of an ITO material or the like may be provided between the face plate 1017 and the fluorescent film 1018, although the embodiment does not employ such electrodes.

Figure 14:
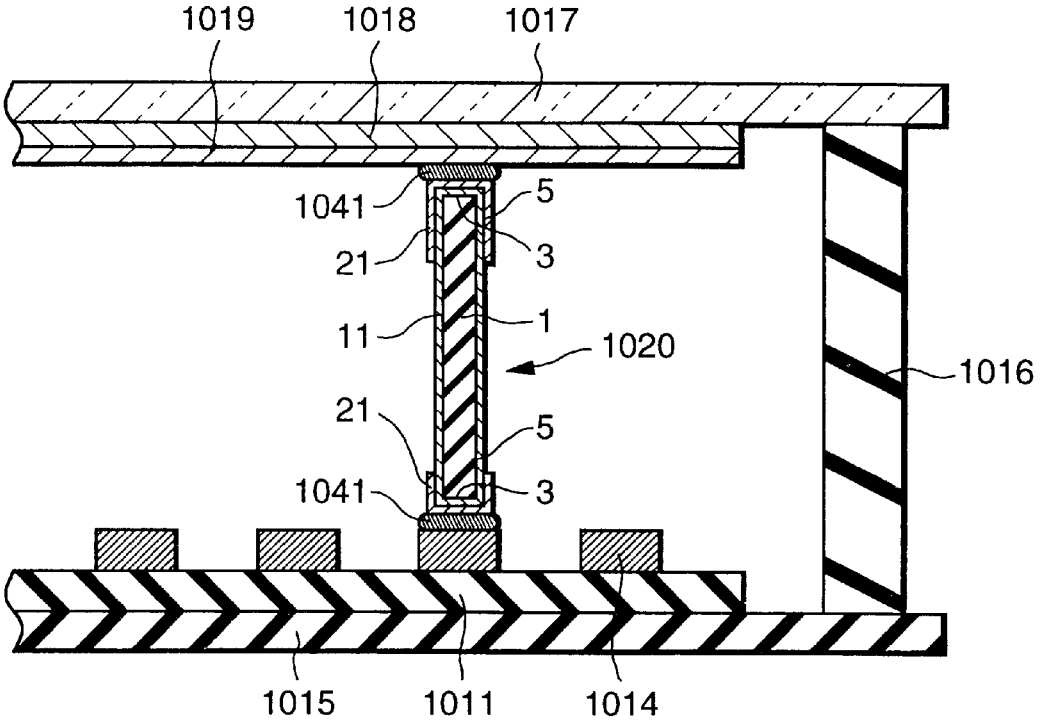
FIG. 14 is a cross-sectional view of the display panel cut out along the line A–A' in FIG. 13.

FIG. 14 is a schematic cross-sectional view cut out along the line A–A' in FIG. 13. Reference numerals of the respective parts are the same as those in FIG. 13. In this embodiment, the spacer 1020 comprises a high-resistance film 11 for relaxing charge-up on the surface of an insulating member 1, in addition to a low-resistance film 21 serving as an electrode for effectively relaxing charge-up near the face plate. The low-resistance film 21 is formed on the surfaces of the insulating member 1 to relax charge-up. Further, the low-resistance film 21 is formed on an abutment surface 3 of the spacer which faces the inner surface (metal back 1019 and the like) of the face plate 1017, and a side surface 5 of the spacer which contacts the inner surface of the face plate 1017. A necessary number of such spacers are fixed on the inner surface of the face plate and the surface of the substrate 1011 at necessary intervals with a joining material 1040 to attain the above purpose. In addition, the high-resistance films 11 are formed at least the surfaces, of the surfaces of the insulating member 1, which are exposed in a vacuum in the airtight container, and are electrically connected to the inner surface (metal back 1019 and the like) of the face plate 1017 and the surface of the substrate 1011 (row- or column-direction wiring 1013 or 1014) via the low-resistance film 21 and the joining material 1040 on the spacer 1020. In this embodiment, each spacer 1020 has a thin plate-like shape, extends along a corresponding row-direction wiring 1013, and is electrically connected thereto.

The spacer 1020 preferably has insulating properties good enough to stand a high voltage applied-between the row- and column-direction wirings 1013 and 1014 on the substrate 1011 and the metal back 1019 on the inner surface of the face plate 1017, and conductivity enough to prevent the surface of the spacer 1020 from being charged.

As the insulating member 1 of the spacer 1020, for example, a silica glass member, a glass member containing a small amount of an impurity such as Na, a soda-lime glass member, or a ceramic member consisting of alumina or the like is available. Note that the insulating member 1 preferably has a thermal expansion coefficient near the thermal expansion coefficients of the airtight container and the substrate 1011.

If a change in potential in the region where the film 21 is formed is ignored, the current obtained by dividing an accelerating voltage Va applied to the face plate 1017 (the metal back 1019 and the like) on the high potential side by a resistance Rs of the high-resistance film 11 for preventing charge-up flows in the high-resistance film 11 of the spacer 1020. The resistance Rs of the spacer is set in a desired range from the viewpoint of prevention of charge-up and consumption power. A sheet resistance R/sq is preferably set to $10^{12}$ Ω/sq or less from the viewpoint of prevention of charge-up. To obtain a sufficient charge-up prevention effect, the sheet resistance R is preferably set to $10^{11}$ Ω/sq or less. The lower limit of this sheet resistance depends on the shape of each spacer and the voltage applied between the spacers, and is preferably set to $10^5$ Ω/sq or more.

The desired range of the resistance of the high-resistance film per unit length in the application direction of the electric field for accelerating electrons depends on the thickness of the film, the width of the spacer, and the sheet resistance, and is preferably $10^7$ to $10^{13}$ Ω/mm.

A thickness t of the high-resistance film formed on the insulating material preferably falls within a range of 10 nm to 1 μm. Although the thickness changes depending on the surface energy of the material, the adhesion properties with the substrate, and the temperature of the substrate, a thin film having a thickness of 10 nm or less is generally formed into an island-like shape and exhibits unstable resistance, resulting in poor reproduction characteristics. In contrast to this, if the thickness t is 1 μm or more, the film stress increases to increase the possibility of peeling of the film. In addition, a longer period of time is required to form a film, resulting in poor productivity. The thickness preferably falls within a range of 50 to 500 nm. The sheet resistance R/sq is ρ/t, and a resistivity ρ of the charge-up prevention film preferably falls within a range of 0.1 Ωcm to $10^8$ Ωcm in consideration of the preferable ranges of R/sq and t. To set the sheet resistance and the film thickness in more preferable ranges, the resistivity ρ is preferably set to $10^2$ to $10^6$ Ωcm.

As described above, when a current flows in the high-resistance film formed on the spacer or the overall display generates heat during operation, the temperature of the spacer rises. If the resistance temperature coefficient of the high-resistance film is a large negative value, the resistance decreases with an increase in temperature. As a result, the current flowing in the spacer increases to raise the temperature. The current keeps increasing beyond the limit of the power source. It is empirically known that the resistance temperature coefficient which causes such an excessive increase in current is a negative value whose absolute value is 1% or more. That is, the resistance temperature coefficient of the high-resistance film is preferably set to less than −1%.

As a material for the high-resistance film 11 having charge-up prevention properties, for example, a metal oxide can be used. Of metal oxides, a chromium oxide, nickel oxide, or copper oxide is preferably used. This is because, these oxides have relatively low secondary electron-emitting efficiency, and are not easily charged even if the electrons emitted by the cold cathode device 1012 collide with the spacer 1020. In addition to such metal oxides, a carbon material is preferably used because it has low secondary electron-emitting efficiency. Since an amorphous carbon material has a high resistance, the resistance of the spacer 1020 can be easily controlled to a desired value.

An aluminum-transition metal nitride is preferable as another material for the high-resistance film 11 having charge-up prevention characteristics because the resistance can be controlled in a wide resistance range from the resistance of a good conductor to the resistance of an insulator by adjusting the composition of the transition metal. This nitride is a stable material which undergoes only a slight change in resistance in the manufacturing process for the display apparatus (to be described later). In addition, this material has a resistance temperature coefficient of less than −1% and hence can be easily used in practice. As a transition metal element, Ti, Cr, Ta, or the like is available.

The film made of the aluminum-transition metal and the nitride (nitride film containing the aluminum-transition metal) is formed on the insulating member by a thin film formation means such as sputtering, reactive sputtering in a nitrogen atmosphere, electron beam deposition, ion plating, or ion-assisted deposition. A metal oxide film can also be formed by the same thin film formation method except that oxygen is used instead of nitrogen. Such a metal oxide film can also be formed by CVD or alkoxide coating. A carbon film is formed by deposition, sputtering, CVD, or plasma CVD. When an amorphous carbon film is to be formed, in particular, hydrogen is contained in an atmosphere in the process of film formation, or a hydrocarbon gas is used as a film formation gas.

The low-resistance film 21 of the spacer 1020 also functions to electrically connect the high-resistance film 11 to the face plate 1017 (metal back 1019 and the like) on the high potential side. The low-resistance film 21 will also be referred to as an intermediate electrode layer (intermediate layer) hereinafter. This intermediate electrode layer (intermediate layer) has a plurality of functions as described below.

1̂ The low-resistance film serves to electrically connect the high-resistance film 11 to the face plate 1017 and the substrate 1011.

As described above, the high-resistance film 11 is formed to prevent the surface of the spacer 1020 from being charged. When, however, the high-resistance film 11 is connected to the face plate 1017 (metal back 1019 and the like) and the substrate 1011 (wirings 1013 and 1014 and the like) directly or via the joining material 1040, a large contact resistance is produced at the interface between the connecting portions. As a result, the charges produced on the surface of the spacer may not be quickly removed. The connected state can be however improved by forming the low-resistance intermediate layer on the abutment surface 3 and the side surface portion 5, of the spacer 1020, which are in contact with the face plate 1017, the substrate 1011, and the joining material 1040.

2̂ The low-resistance film serves to make the potential distribution of the high-resistance film 11 uniform.

Electrons emitted by the cold cathode devices 1012 follow the orbits formed in accordance with the potential distribution formed between the face plate 1017 and the substrate 1011. To prevent the electron orbits from being disturbed near the spacer 1020, the entire potential distribution of the spacer 1020 must be controlled. When the high-resistance film 11 is connected to the face plate 1017 (metal back 1019 and the like) and the substrate 1011 (wiring 1013 or 1014 and the like) directly or via the joining material 1040, variations in the connected state occurs owing to the contact resistance of the interface between the connecting portions. As a result, the potential distribution of the high-resistance film 11 may deviate from a desired value. To avoid this, if the low-resistance intermediate layer is formed throughout the entire lengths of the spacer end portions (abutment surface 3 or side surface portion 5), of the spacer 1020, which are in contact with the face plate 1017 and the substrate 1011, and a desired potential is applied to the intermediate layer portion, the overall potential of the high-resistance film 11 can be effectively controlled.

3̂ The intermediate layer serves to control the orbits of emitted electrons.

Electrons emitted by the cold cathode devices 1012 follow the orbits formed in accordance with the potential distribution formed between the face plate 1017 and the substrate 1011. Electrons emitted by the cold cathode devices near the spacer may be subjected to constrains (changes in the positions of the wirings and the devices) accompanying the structure of the spacer. In this case, to form an image free from distortion and irregularity, the orbits of the electrons emitted by the cold cathode devices must be controlled to irradiate the electrons at desired positions on the face plate 1017. The formation of the low-resistance intermediate layers on the side surface portions 5 in contact with the face plate 1017 and the substrate 1011 allows the potential distribution near the spacer 1020 to have desired characteristics, thereby controlling the orbits of emitted electrons.

As a material for the low-resistance film 21, a material having a resistance sufficiently lower than that of the high-resistance film 11 can be selected. For example, such a material is properly selected from metals such as Ni, Cr, Au, Mo, W, Pt, Ti, Al, Cu, and Pd, alloys thereof, printed conductors constituted by metals such as Pd, Ag, Au, $RuO_2$, and Pd-Ag or metal oxides and glass or the like, transparent conductors such as $In_2O_3$—$SnO_2$, and semiconductor materials such as polysilicon.

The joining material 1040 needs to have conductivity to electrically connect the spacer 1020 to the row-direction wiring 1013 and the metal back 1019. That is, a conductive adhesive or frit glass containing metal particles or conductive filler is suitably used.

In FIG. 13, symbols Dx1 to Dxm, Dy1 to Dyn and Hv denote electric connection terminals for airtight structure provided for electrical connection of the display panel with an electric circuit (not shown). The terminals Dx1 to Dxm are electrically connected to the row-direction wiring 1013 of the multi electron-beam source; Dy1 to Dyn, to the column-direction wiring 1014 of the multi electron-beam source; and Hv, to the metal back 1019 of the face plate.

To exhaust air from the inside of the airtight container and make the inside vacuum, after forming the airtight container, an exhaust pipe and a vacuum pump (neither is shown) are connected, and air is exhausted from the airtight container to vacuum at about $10^{-7}$ Torr. Thereafter, the exhaust pipe is sealed. To maintain the vacuum condition inside of the airtight container, a getter film (not shown) is formed at a predetermined position in the airtight container, immediately before/after the sealing. The getter film is a film formed by heating and evaporating getter material mainly including, e.g., Ba, by heating or high-frequency heating. The suction-attaching operation of the getter film maintains the vacuum condition in the container $1\times10^{-5}$ or $1\times10^{-7}$ Torr.

In the image display apparatus using the above display panel, when a voltage is applied to the cold cathode devices 1012 via the outer terminals Dx1 to DxM and Dy1 to DyN, electrons are emitted by the cold cathode devices 1012. At the same time, a high voltage of several hundreds V to several kV is applied to the metal back 1019 via the outer terminal Hv to accelerate the emitted electrons to cause them collide with the inner surface of the face plate 1017. With this operation, the respective color fluorescent substances constituting the fluorescent film 1018 are excited to emit light, thereby displaying an image.

The voltage to be applied to each SCE type electron-emitting device 1012 as a cold cathode device in the present invention is normally set to about 12 to 16 V; a distance d between the metal back 1019 and the cold cathode device 1012, about 0.1 mm to 8 mm; and the voltage to be applied across the metal back 1019 and the cold cathode device 1012, about 0.1 kV to 10 kV.

The basic structure and manufacturing method of the display panel, and the general description of the image display apparatus according to the embodiment of the present invention have been described.

Manufacturing Method of Multi Electron-Beam Source

Next, the manufacturing method of the multi electron-beam source used in the display panel according to the embodiment of the present invention will be described. As far as the multi electron-beam source used in the image display apparatus of the present invention is obtained by arranging cold cathode devices in a simple matrix, the material, shape, and manufacturing method of the cold cathode device are not limited. As the cold cathode device, therefore, an SCE type electron-emitting device or an FE type or MIM type cold cathode device can be used.

Under circumstances where inexpensive display apparatuses having large display screens are required, an SCE type electron-emitting device, of these cold cathode devices, is especially preferable. More specifically, the electron-emitting characteristic of an FE type device is greatly influenced by the relative positions and shapes of the emitter cone and the gate electrode, and hence a high-precision manufacturing technique is required to manufacture this device. This poses a disadvantageous factor in attaining a large display area and a low manufacturing cost. According to an MIM type device, the thicknesses of the insulating layer and the upper electrode must be decreased and made uniform. This also poses a disadvantageous factor in attaining a large display area and a low manufacturing cost. In contrast to this, an SCE type electron-emitting device can be manufactured by a relatively simple manufacturing method, and hence an increase in display area and a decrease in manufacturing cost can be attained. The present inventors have also found that among the SCE type electron-emitting devices, an electron-beam source where an electron-emitting portion or its peripheral portion comprises a fine particle film is excellent in electron-emitting characteristic and further, it can be easily manufactured. Accordingly, this type of electron-beam source is the most appropriate electron-beam source to be employed in a multi electron-beam source of a high luminance and large-screened image display apparatus. In the display panel of the embodiment, SCE type electron-emitting devices each having an electron-emitting portion or peripheral portion formed from a fine particle film are employed. First, the basic structure, manufacturing method and characteristic of the preferred SCE type electron-emitting device will be described, and the structure of the multi electron-beam source having simple-matrix wired SCE type electron-emitting devices will be described later.

Preferred Structure and Manufacturing Method of SCE Device

The typical structure of the SCE type electron-emitting device where an electron-emitting portion or its peripheral portion is formed from a fine particle film includes a flat type structure and a stepped type structure.

Flat SEC Type Electron-Emitting Device

Figure 6A:
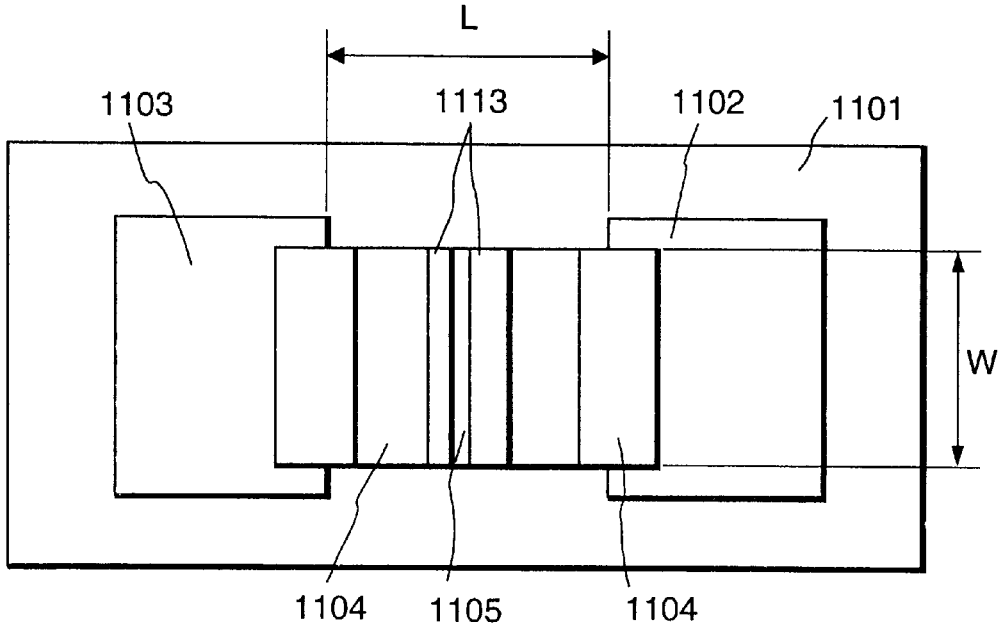
FIGS. 6A and 6B are a plan view and a cross-sectional view, respectively, of a flat surface-conduction emission type electron-emitting device used in the embodiment.
Figure 6B:
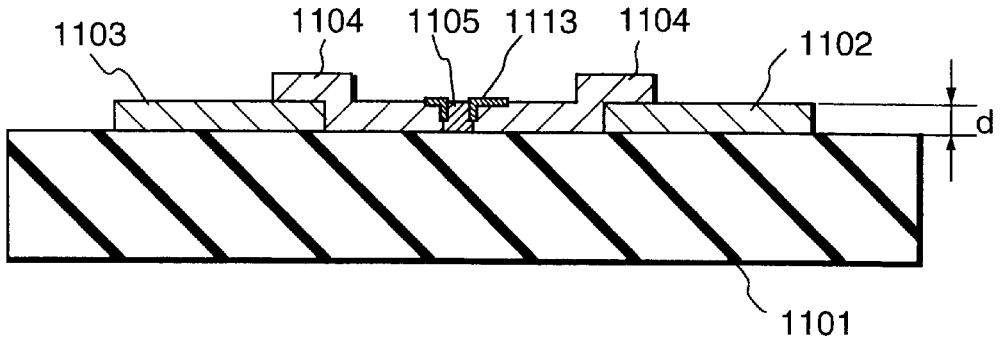

First, the structure and manufacturing method of a flat SCE type electron-emitting device will be described. FIG. 6A is a plan view explaining the structure of the flat SCE type electron-emitting device; and FIG. 6B, a cross-sectional view of the device. In FIGS. 6A and 6B, numeral 1101 denotes a substrate; 1102 and 1103, device electrodes; 1104, a conductive thin film; 1105, an electron-emitting portion formed by the forming processing; and 1113, a thin film formed by the activation processing.

As the substrate 1101, various glass substrates of, e.g., quartz glass and soda-lime glass, various ceramic substrates of, e.g., alumina, or any of those substrates with an insulating layer formed of, e.g., $SiO_2$ thereon can be employed.

The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. The electrode is easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundreds angstroms to hundreds micrometers. Most preferable range for a display apparatus is from several micrometers to tens micrometers. As for electrode thickness d, an appropriate value is selected from a range from hundreds angstroms to several micrometers.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other.

One particle has a diameter within a range from several angstroms to thousands angstroms. Preferably, the diameter is within a range from 10 angstroms to 200 angstroms. The thickness of the film is appropriately set in consideration of conditions as follows. That is, condition necessary for electrical connection to the device electrode 1102 or 1103, condition for the forming processing to be described later, condition for setting electric resistance of the fine particle film itself to an appropriate value to be described later etc. Specifically, the thickness of the film is set in a range from several angstroms to thousands angstroms, more preferably, 10 angstroms to 500 angstroms.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, and carbons. Any of appropriate material(s) is appropriately selected.

As described above, the conductive thin film 1104 is formed with a fine particle film, and sheet resistance of the film is set to reside within a range from $10^3$ to $10^7$ (Ω/sq)

As it is preferable that the conductive thin film 1104 is electrically connected to the device electrodes 1102 and 1103, they are arranged so as to overlap with each other at one portion. In FIG. 6B, the respective parts are overlapped in order of, the substrate, the device electrodes, and the conductive thin film, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than peripheral conductive thin film. The fissure is formed by the forming processing to be described later on the conductive thin film 1104. In some cases, particles, having a diameter of several angstroms to hundreds angstroms, are arranged within the fissured portion. As it is difficult to exactly illustrate actual position and shape of the electron-emitting portion, therefore, FIGS. 6A and 6B show the fissured portion schematically.

The thin film 1113, which comprises carbon or carbon compound material, covers the electron-emitting portion 1115 and its peripheral portion. The thin film 1113 is formed by the activation processing to be described later after the forming processing.

The thin film 1113 is preferably graphite monocrystalline, graphite polycrystalline, amorphous carbon, or mixture thereof, and its thickness is 500 angstroms or less, more preferably, 300 angstroms or less. As it is difficult to exactly illustrate actual position or shape of the thin film 1113, FIGS. 6A and 6B show the film schematically. FIG. 6A shows the device where a part of the thin film 1113 is removed.

The preferred basic structure of SCE type electron-emitting device is as described above. In the embodiment, the device has the following constituents.

That is, the substrate 1101 comprises a soda-lime glass, and the device electrodes 1102 and 1103, an Ni thin film. The electrode thickness d is 1000 angstroms and the electrode interval L is 2 micrometers.

The main material of the fine particle film is Pd or PdO. The thickness of the fine particle film is about 100 angstroms, and its width W is 100 micrometers.

Next, a method of manufacturing a preferred flat SCE type electron-emitting device will be described with reference to FIGS. 7A to 7E which are cross-sectional views showing the manufacturing processes of the SCE type electron-emitting device. Note that reference numerals are the same as those in FIGS. 6A and 6B.

Figure 7A:
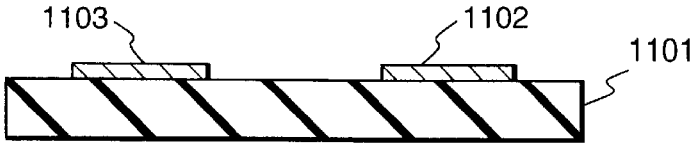
FIGS. 7A to 7E are views respectively showing the steps in manufacturing the flat surface-conduction emission type electron-emitting device.

(1) First, as shown in FIG. 7A, the device electrodes 1102 and 1103 are formed on the substrate 1101.

Upon formation of the electrodes 1102 and 1103, first, the substrate 1101 is fully washed with a detergent, pure water and an organic solvent, then, material of the device electrodes is deposited there (as a depositing method, a vacuum film-forming technique such as evaporation and sputtering may be used). Thereafter, patterning using a photolithography etching technique is performed on the deposited electrode material. Thus, the pair of device electrodes 1102 and 1103 shown in FIG. 7A are formed.

Figure 7B:
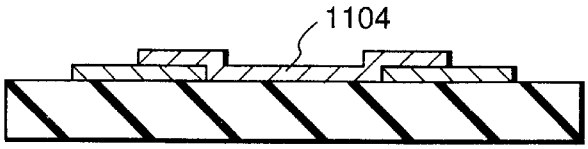

(2) Next, as shown in FIG. 7B, the conductive thin film 1104 is formed.

Upon formation of the conductive thin film 1104, first, an organic metal solvent is applied to the substrate 1101 in FIG. 7A, then the applied solvent is dried and sintered, thus forming a fine particle film. Thereafter, the fine particle film is patterned, in accordance with the photolithography etching method, into a predetermined shape. The organic metal solvent means a solvent of organic metal compound containing material of minute particles, used for forming the conductive thin film, as main component (i.e., Pd in this embodiment). In the embodiment, application of organic metal solvent is made by dipping, however, any other method such as a spinner method and spraying method may be employed.

As a film-forming method of the conductive thin film made with the minute particles, the application of organic metal solvent used in the embodiment can be replaced with any other method such as a vacuum evaporation method, a sputtering method or a chemical vapor-phase accumulation method.

Figure 7C:
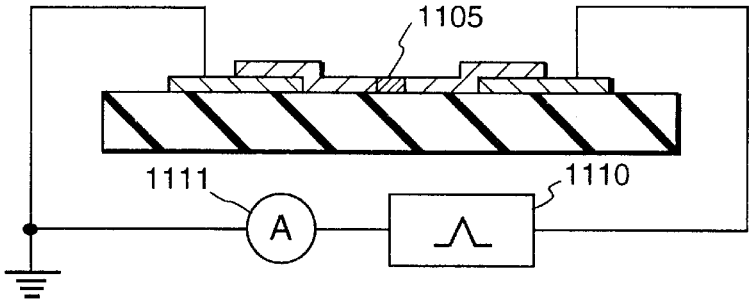

(3) Then, as shown in FIG. 7C, appropriate voltage is applied between the device electrodes 1102 and 1103, from a power source 1110 for the forming processing, then the forming processing is performed, thus forming the electron-emitting portion 1105.

The forming processing here is electric energization of a conductive thin film 1104 formed of a fine particle film, to appropriately destroy, deform, or deteriorate a part of the conductive thin film, thus changing the film to have a structure suitable for electron emission. In the conductive thin film, the portion changed for electron emission (i.e., electron-emitting portion 1105) has an appropriate fissure in the thin film. Comparing the thin film 1104 having the electron-emitting portion 1105 with the thin film before the forming processing, the electric resistance measured between the device electrodes 1102 and 1103 has greatly increased.

Figure 8:
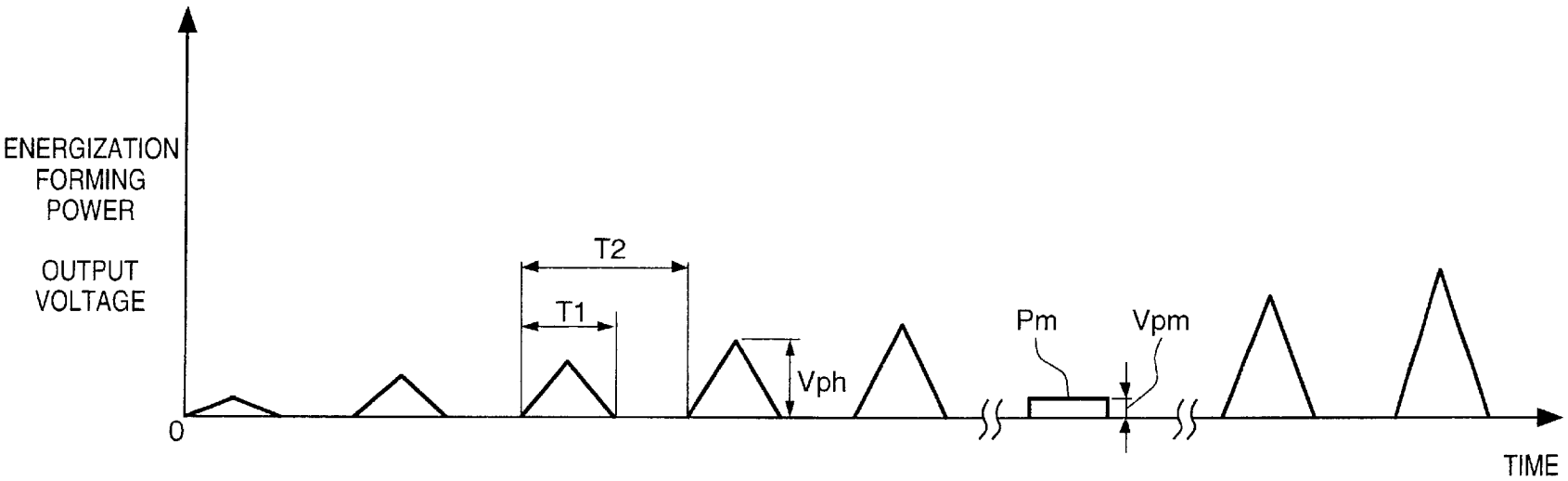
FIG. 8 is a graph showing the waveform of the application voltage in forming processing.

The forming processing will be explained in detail with reference to FIG. 8 showing an example of waveform of appropriate voltage applied from the forming power source 1110. Preferably, in case of forming a conductive thin film of a fine particle film, a pulse-form voltage is employed. In this embodiment, a triangular-wave pulse having a pulse width T1 is continuously applied at pulse interval of T2, as shown in FIG. 8. Upon application, a wave peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this example, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electric resistance between the device electrodes 1102 and 1103 becomes $1\times10^{6}$ Ω, i.e., the current measured by the galvanometer 1111 upon application of monitor pulse becomes $1\times10^{-7}$ A or less, the electrification of the forming processing is terminated.

Note that the above processing method is preferable to the SCE type electron-emitting device of this embodiment. In case of changing the design of the SCE type electron-emitting device concerning, e.g., the material or thickness of the fine particle film, or the device electrode interval L, the conditions for electrification are preferably changed in accordance with the change of device design.

Figure 7D:
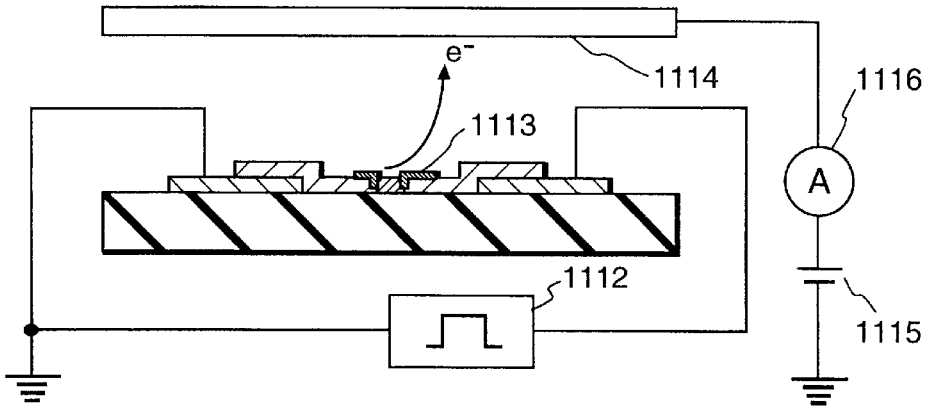

(4) Next, as shown in FIG. 7D, appropriate voltage is applied, from an activation power source 1112, between the device electrodes 1102 and 1103, and the activation processing is performed to improve electron-emitting characteristics obtained in the preceding step.

The activation processing here is electrification of the electron-emitting portion 1105, formed by the forming processing, on appropriate condition(s), for depositing carbon or carbon compound around the electron-emitting portion 1105 (In FIG. 7D, the deposited material of carbon or carbon compound is shown as material 1113). Comparing the electron-emitting portion 1105 with that before the activation processing, the emission current at the same applied voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 9A:
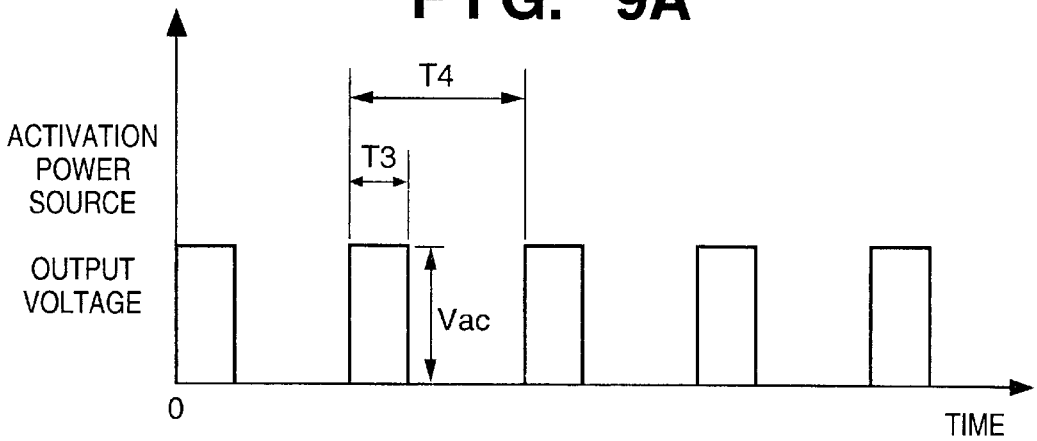
FIGS. 9A and 9B are graphs respectively showing the waveform of the application voltage and a change in emission current Ie in activation processing.

The activation processing will be described in more detail with reference to FIG. 9A showing an example of waveform of appropriate voltage applied from the activation power source 1112. In this example, a rectangular wave at a predetermined voltage is applied to perform the activation processing. More specifically, a rectangular-wave voltage Vac is set to 14 V; a pulse width T3, to 1 msec; and a pulse interval T4, to 10 msec. Note that the above electrification conditions are preferable for the SCE type electron-emitting device of the embodiment. In a case where the design of the SCE type electron-emitting device is changed, the electrification conditions are preferably changed in accordance with the change of device design.

Figure 9B:
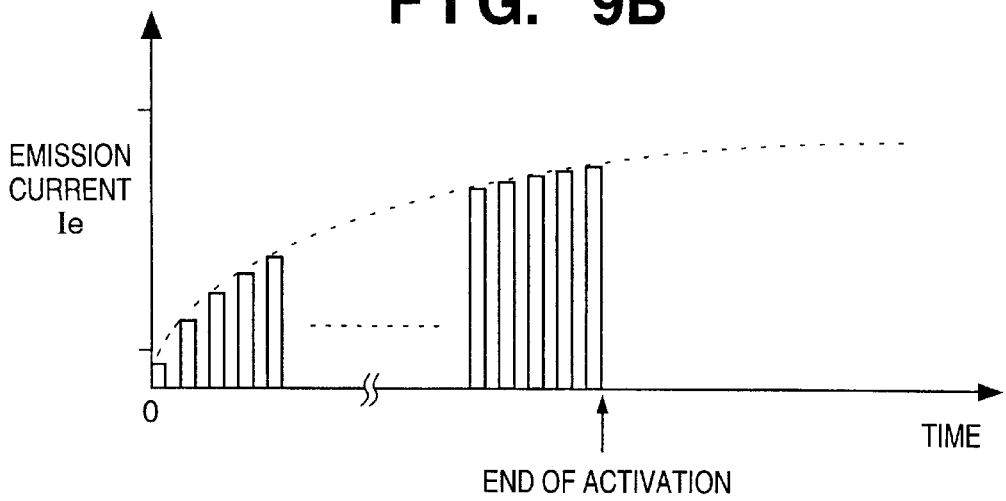

In FIG. 7D, numeral 1114 denotes an anode electrode, connected to a direct-current (DC) high-voltage power source 1115 and a galvanometer 1116, for capturing emission current Ie emitted from the SCE type electron-emitting device (in a case where the substrate 1101 is incorporated into the display panel before the activation processing, the Al layer on the fluorescent surface of the display panel is used as the anode electrode 1114). While applying voltage from the activation power source 1112, the galvanometer 1116 measures the emission current Ie, thus monitors the progress of activation processing, to control the operation of the activation power source 1112. FIG. 9B shows an example of the emission current Ie measured by the galvanometer 1116. In this example, as application of pulse voltage from the activation power source 1112 is started, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the SCE type electron-emitting device of the embodiment. In case of changing the design of the SCE type electron-emitting device, the conditions are preferably changed in accordance with the change of device design.

Figure 7E:
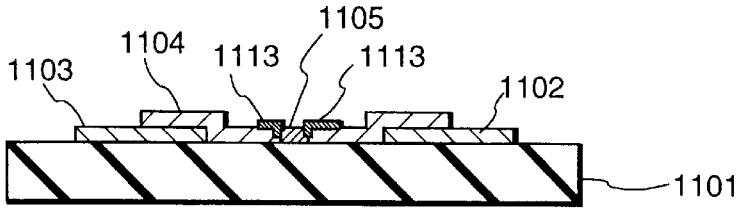

As described above, the SCE type electron-emitting device as shown in FIG. 7E is manufactured.

Step SCE Type Electron-Emitting Device

Next, another typical structure of the SCE type electron-emitting device where an electron-emitting portion or its peripheral portion is formed of a fine particle film, i.e., a stepped SCE type electron-emitting device will be described.

Figure 10:
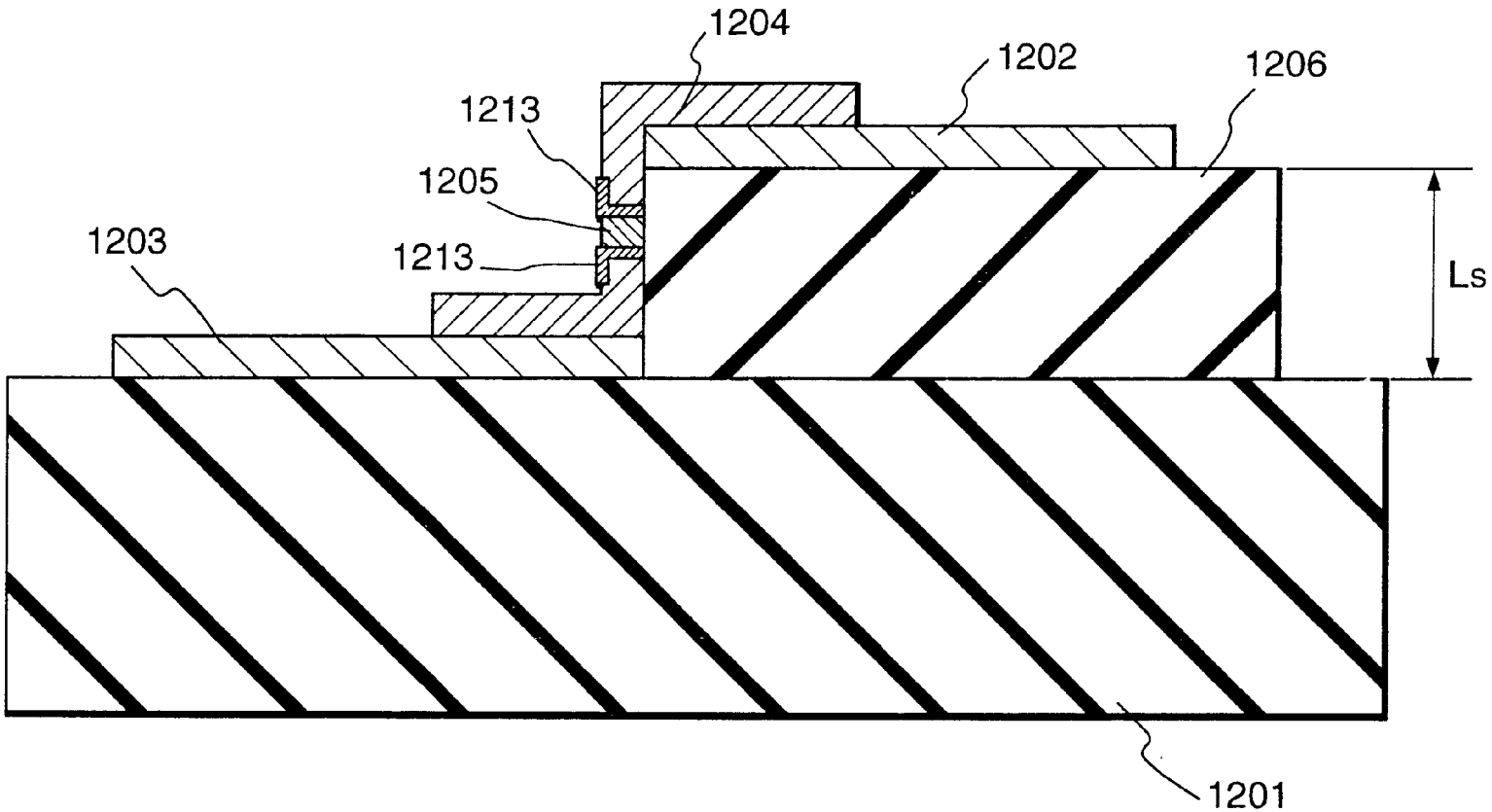
FIG. 10 is a cross-sectional view of a step surface-conduction emission type electron-emitting device used in the embodiment.

FIG. 10 is across-sectional view schematically showing the basic construction of the step SCE type electron-emitting device. In FIG. 10, numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by the forming processing; and 1213, a thin film formed by the activation processing.

Difference between the step device structure from the above-described flat device structure is that one of the device electrodes (1202 in this example) is provided on the step-forming member 1206 and the conductive thin film 1204 covers the side surface of the step-forming member 1206. The device interval L in FIG. 10 is set in this structure as a height difference Ls corresponding to the height of the step-forming member 1206. Note that the substrate 1201, the device electrodes 1202 and 1203, the conductive thin film 1204 using the fine particle film can comprise the materials given in the explanation of the flat SCE type electron-emitting device. Further, the step-forming member 1206 comprises electrically insulating material such as $SiO_2$.

Next, a method of manufacturing the stepped SCE type electron-emitting device will be described with reference FIGS. 11A to 11F which are cross-sectional views showing the manufacturing processes. In these figures, reference numerals of the respective parts are the same as those in FIG. 9.

Figure 11A:
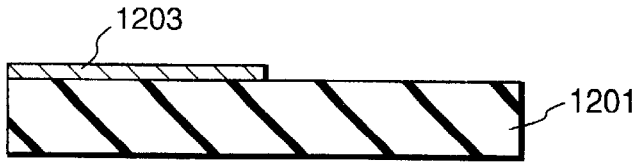
FIGS. 11A to 11F are views respectively showing the steps in manufacturing the step surface-conduction emission type electron-emitting device.

(1) First, as shown in FIG. 11A, the device electrode 1203 is formed on the substrate 1201.

Figure 11B:
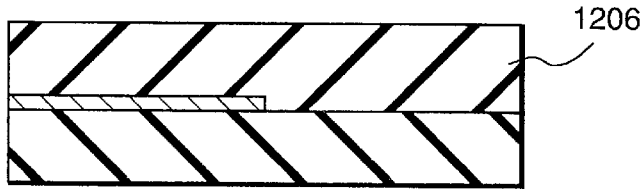

(2) Next, as shown in FIG. 11B, an insulating layer for forming the step-forming member is deposited. The insulating layer may be formed by accumulating, e.g., $SiO_2$ by a sputtering method, however, the insulating layer may be formed by a film-forming method such as a vacuum evaporation method or a printing method.

Figure 11C:
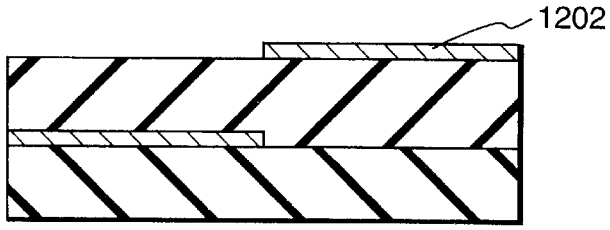

(3) Next, as shown in FIG. 11C, the device electrode 1202 is formed on the insulating layer.

Figure 11D:
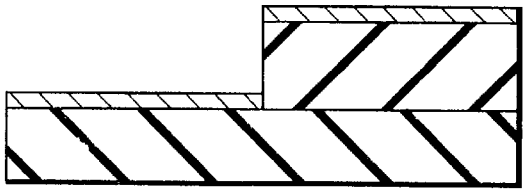

(4) Next, as shown in FIG. 11D, a part of the insulating layer is removed by using, e.g., an etching method, to expose the device electrode 1203.

Figure 11E:
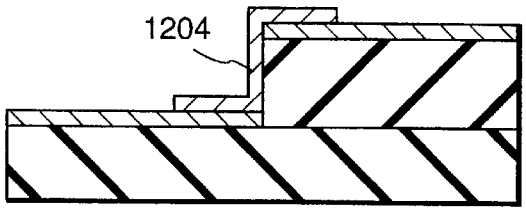

(5) Next, as shown in FIG. 11E, the conductive thin film 1204 using the fineparticle film is formed. Upon formation, similar to the above-described flat device structure, a film-forming technique such as an applying method is used.

(6) Next, similar to the flat device structure, the forming processing is performed to form the electron-emitting portion 1205 (the forming processing similar to that explained using FIG. 7C may be performed).

(7) Next, similar to the flat device structure, the activation processing is performed to deposit carbon or carbon compound around the electron-emitting portion (activation processing similar to that explained using FIG. 7D may be performed).

Figure 11F:
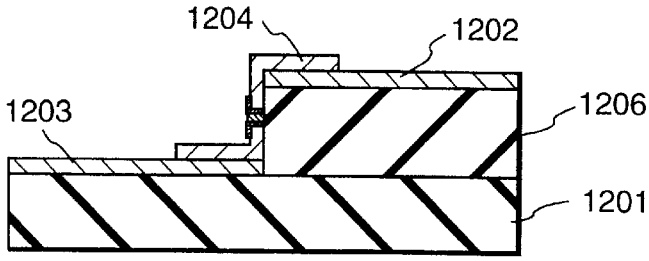

As described above, the stepped SCE type electron-emitting device shown in FIG. 11F is manufactured.

Characteristic of SCE Type Electron-Emitting Device Used in Display Apparatus

The structure and manufacturing method of the flat SCE type electron-emitting device and those of the stepped SCE type electron-emitting device are as described above. Next, the characteristic of the electron-emitting device used in the display apparatus will be described below.

Figure 12:
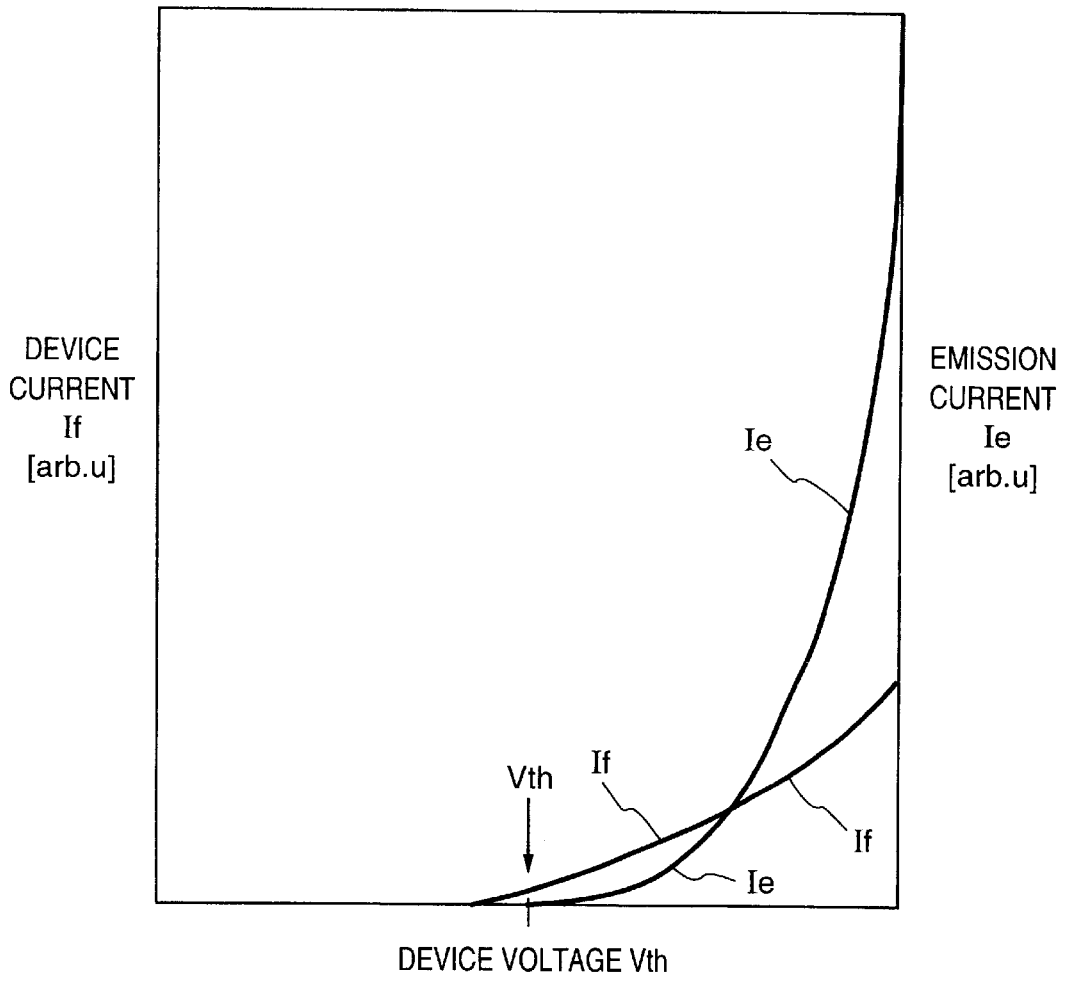
FIG. 12 is a graph showing typical characteristics of the surface-conduction emission type electron-emitting device used in the embodiment.

FIG. 12 shows a typical example of (emission current Ie) to (device voltage (i.e., voltage to be applied to the device) Vf) characteristic and (device current If) to (device application voltage Vf) characteristic of the device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 12 are respectively given in arbitrary units.

Regarding the emission current Ie, the device used in the display apparatus has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected.

That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the device voltage Vf.

Third, the emission current Ie is output quickly in response to application of the device voltage Vf. Accordingly, an electrical charge amount of electrons to be emitted from the device can be controlled by changing period of application of the device voltage Vf.

The SCE type electron-emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-gradation display.

Structure of Simple-Matrix Wired Multi Electron-Beam Source

Next, the structure of a multi electron-beam source where a large number of the above SCE type electron-emitting devices are arranged with the simple-matrix wiring will be described below.

FIG. 15 is a plan view of the multi electron-beam source used in the display panel in FIG. 13. There are SCE type electron-emitting devices similar to those shown in FIGS. 6A and 6B on the substrate. These devices are arranged in a simple matrix with the row-direction wiring 1013 and the column-direction wiring 1014. At an intersection of the wirings 1013 and 1014, an insulating layer (not shown) is formed between the wires, to maintain electrical insulation.

FIG. 16 shows a cross-section cut out along the line B–B' in FIG. 15.

Note that this type multi electron-beam source is manufactured by forming the row- and column-direction wirings 1013 and 1014, the insulating layers (not shown) at wires' intersections, the device electrodes and conductive thin films on the substrate, then supplying electricity to the respective devices via the row- and column-direction wirings 1013 and 1014, thus performing the forming processing and the activation processing.

Figure 17:
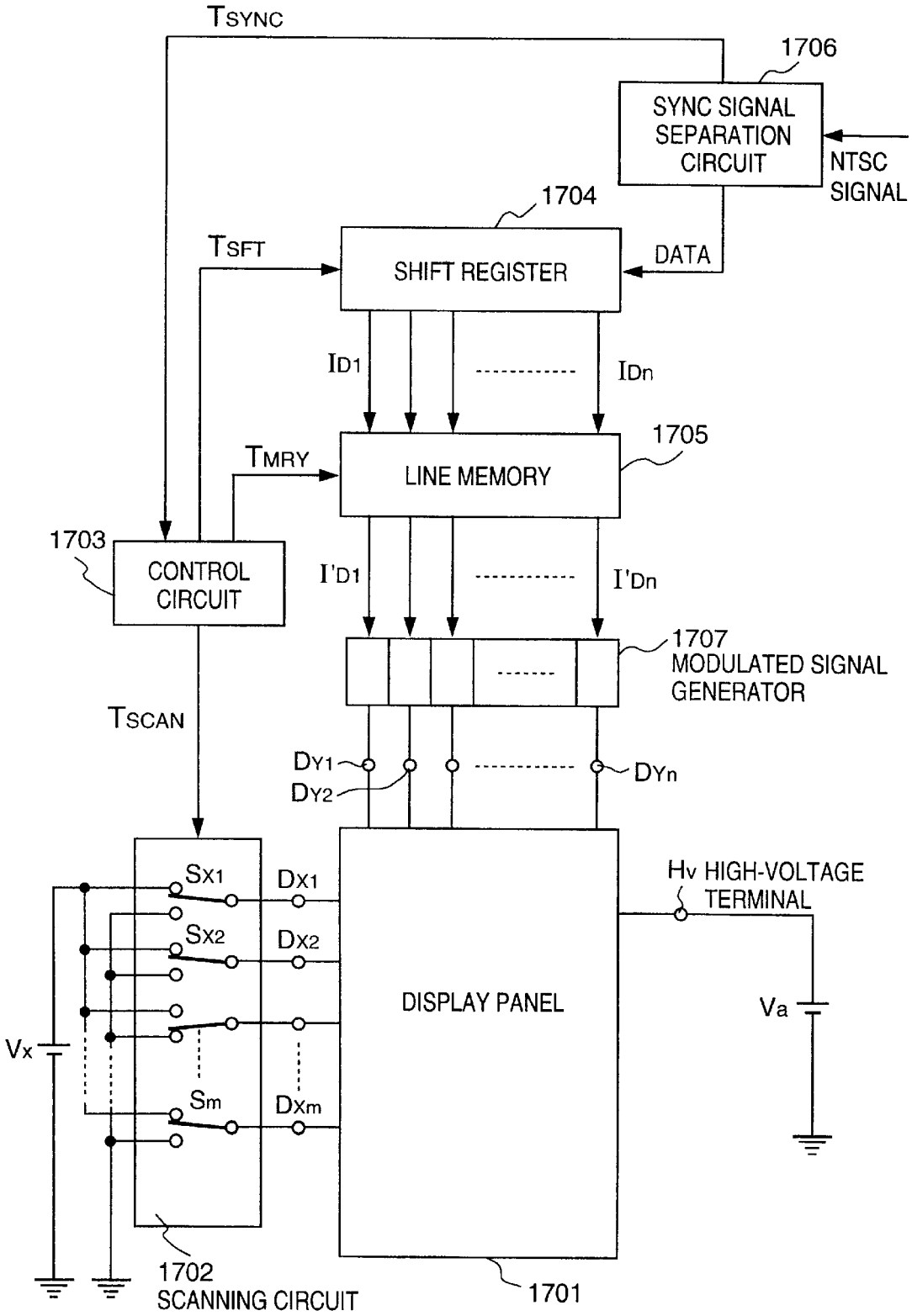
FIG. 17 is a block diagram showing the schematic arrangement of a driving circuit for the image display apparatus of the embodiment.

FIG. 17 is a block diagram showing the schematic arrangement of a driving circuit for performing television display on the basis of a television signal of the NTSC scheme.

Referring to FIG. 17, a display panel 1701 is manufactured and operates in the same manner described above. A scanning circuit 1702 scans display lines. A control circuit 1703 generates signals and the like to be input to the scanning circuit 1702. A shift register 1704 shifts data in units of lines. A line memory 1705 inputs 1-line data from the shift register 1704 to a modulated signal generator 1707. A sync signal separation circuit 1706 separates a sync signal from an NTSC signal.

The function of each component in FIG. 17 will be described in detail below.

The display panel 1701 is connected to an external electric circuit through terminals Dx1 to Dxm and Dy1 to Dyn and a high-voltage terminal Hv. Scanning signals for sequentially driving an electron source 1 in the display panel 1701, i.e., a group of electron-emitting devices 15 wired in a m x n matrix in units of lines (in units of n devices) are applied to the terminals Dx1 to Dxm.

Modulated signals for controlling the electron beams output from the electron-emitting devices 15 corresponding to one line, which are selected by the above scanning signals, are applied to the terminals Dy1 to Dyn. For example, a DC voltage of 5 kV is applied from a DC voltage source Va to the high-voltage terminal Hv. This voltage is an accelerating voltage for giving energy enough to excite the fluorescent substances to the electron beams output from the electron-emitting devices 15.

The scanning circuit 1702 will be described next.

This circuit incorporates m switching elements (denoted by reference symbols S1 to Sm in FIG. 17). Each switching element serves to select either an output voltage from a DC voltage source Vx or 0 V (ground level) and is electrically connected to a corresponding one of the terminals Dox1 to Doxm of the display panel 1701. The switching elements S1 to Sm operate on the basis of a control signal Tscan output from the control circuit 1703. In practice, this circuit can be easily formed in combination with switching elements such as FETs.

The DC voltage source Vx is set on the basis of the characteristics of the electron-emitting device in FIG. 12 to output a constant voltage such that the driving voltage to be applied to a device which is not scanned is set to an electron emission threshold voltage Vth or lower.

The control circuit 1703 serves to match the operations of the respective components with each other to perform proper display on the basis of an externally input image signal. The control circuit 1703 generates control signals Tscan, Tsft, and Tmry for the respective components on the basis of a sync signal Tsync sent from the sync signal separation circuit 1706 to be described next.

The sync signal separation circuit 1706 is a circuit for separating a sync signal component and a luminance signal component from an externally input NTSC television signal. As is known well, this circuit can be easily formed by using a frequency separation (filter) circuit. The sync signal separated by the sync signal separation circuit 1706 is constituted by vertical and horizontal sync signals, as is known well. In this case, for the sake of descriptive convenience, the sync signal is shown as the signal Tsync. The luminance signal component of an image, which is separated from the television signal, is expressed as a signal DATA for the sake of descriptive convenience. This signal is input to the shift register 1704.

The shift register 1704 performs serial/parallel conversion of the signal DATA, which is serially input in a time-series manner, in units of lines of an image. The shift register 1704 operates on the basis of the control signal Tsft sent from the control circuit 1703. In other words, the control signal Tsft is a shift clock for the shift register 1704. one-line data (corresponding to driving data for n electron-emitting devices) obtained by serial/parallel conversion is output as n signals ID1 to IDn from the shift register 1704.

The line memory 1705 is a memory for storing 1-line data for a required period of time. The line memory 1705 properly stores the contents of the signals ID1 to IDn in accordance with the control signal Tmry sent from the control circuit 1703. The stored contents are output as data I'D1 to I'Dn to be input to a modulated signal generator 1707.

The modulated signal generator 1707 is a signal source for performing proper driving/modulation with respect to each electron-emitting device 15 in accordance with each of the image data I'D1 to I'Dn. Output signals from the modulated signal generator 1707 are applied to the electron-emitting devices 15 in the display panel 1701 through the terminals Doy1 to Doyn.

The electron-emitting device 15 according to the present invention has the following basic characteristics with respect to an emission current Ie, as described above with reference to FIG. 12. A clear threshold voltage Vth (8 V in the surface-conduction emission type electron-emitting device of the embodiment described later) is set for electron emission. Each device emits electrons only when a voltage equal to or higher than the threshold voltage Vth is applied.

In addition, the emission current Ie changes with a change in voltage equal to or higher than the electron emission threshold voltage Vth, as shown in FIG. 12. Obviously, when a pulse-like voltage is to be applied to this device, no electrons are emitted if the voltage is lower than the electron emission threshold voltage Vth. If, however, the voltage is equal to or higher than the electron emission threshold voltage Vth, the electron-emitting device emits an electron beam. In this case, the intensity of the output electron beam can be controlled by changing a peak value Vm of the pulse. In addition, the total amount of electron beam charges output from the device can be controlled by changing a width Pw of the pulse.

As a scheme of modulating an output from each electron-emitting device in accordance with an input signal, therefore, a voltage modulation scheme, a pulse width modulation scheme, or the like can be used. In executing the voltage modulation scheme, a voltage modulation circuit for generating a voltage pulse with a constant length and modulating the peak value of the pulse in accordance with input data can be used as the modulated signal generator 1707. In executing the pulse width modulation scheme, a pulse width modulation circuit for generating a voltage pulse with a constant peak value and modulating the width of the voltage pulse in accordance with input data can be used as the modulated signal generator 1707.

The shift register 1704 and the line memory 1705 may be of the digital signal type or the analog signal type. That is, it suffices if an image signal is serial/parallel-converted and stored at predetermined speeds.

When the above components are of the digital signal type, the output signal DATA from the sync signal separation circuit 1706 must be converted into a digital signal. For this purpose, an A/D converter may be connected to the output terminal of the sync signal separation circuit 1706. Slightly different circuits are used for the modulated signal generator depending on whether the line memory 1705 outputs a digital or analog signal. More specifically, in the case of the voltage modulation scheme using a digital signal, for example, a D/A conversion circuit is used as the modulated signal generator 1707, and an amplification circuit and the like are added thereto, as needed. In the case of the pulse width modulation scheme, for example, a circuit constituted by a combination of a high-speed oscillator, a counter for counting the wave number of the signal output from the oscillator, and a comparator for comparing the output value from the counter with the output value from the memory is used as the modulated signal generator 1707. This circuit may include, as needed, an amplifier for amplifying the voltage of the pulse-width-modulated signal output from the comparator to the driving voltage for the electron-emitting device.

In the case of the voltage modulation scheme using an analog signal, for example, an amplification circuit using an operational amplifier and the like may be used as the modulated signal generator 1707, and a shift level circuit and the like may be added thereto, as needed. In the case of the pulse width modulation scheme, for example, a voltage-controlled oscillator (VCO) can be used, and an amplifier for amplifying an output from the oscillator to the driving voltage for the electron-emitting device can be added thereto, as needed.

In the image display apparatus of this embodiment which can have one of the above arrangements, when voltages are applied to the respective electron-emitting devices through the outer terminals Dx1 to Dxm and Dy1 to Dyn, electrons are emitted. A high voltage is applied to the metal back 1019 or the transparent electrode (not shown) through the high-voltage terminal Hv to accelerate the electron beams. The accelerated electrons collide with the fluorescent film 1018 to cause it to emit light, thereby forming an image.

The above arrangement of the image display apparatus is an example of an image forming apparatus to which the present invention can be applied. Various changes and modifications of this arrangement can be made within the spirit and scope of the present invention. Although a signal based on the NTSC scheme is used as an input signal, the input signal is not limited to this. For example, the PAL scheme and the SECAM scheme can be used. In addition, a TV signal (high-definition TV such as MUSE) scheme using a larger number of scanning lines than these schemes can be used.

Structure of Intermediate Layer

Figure 1:
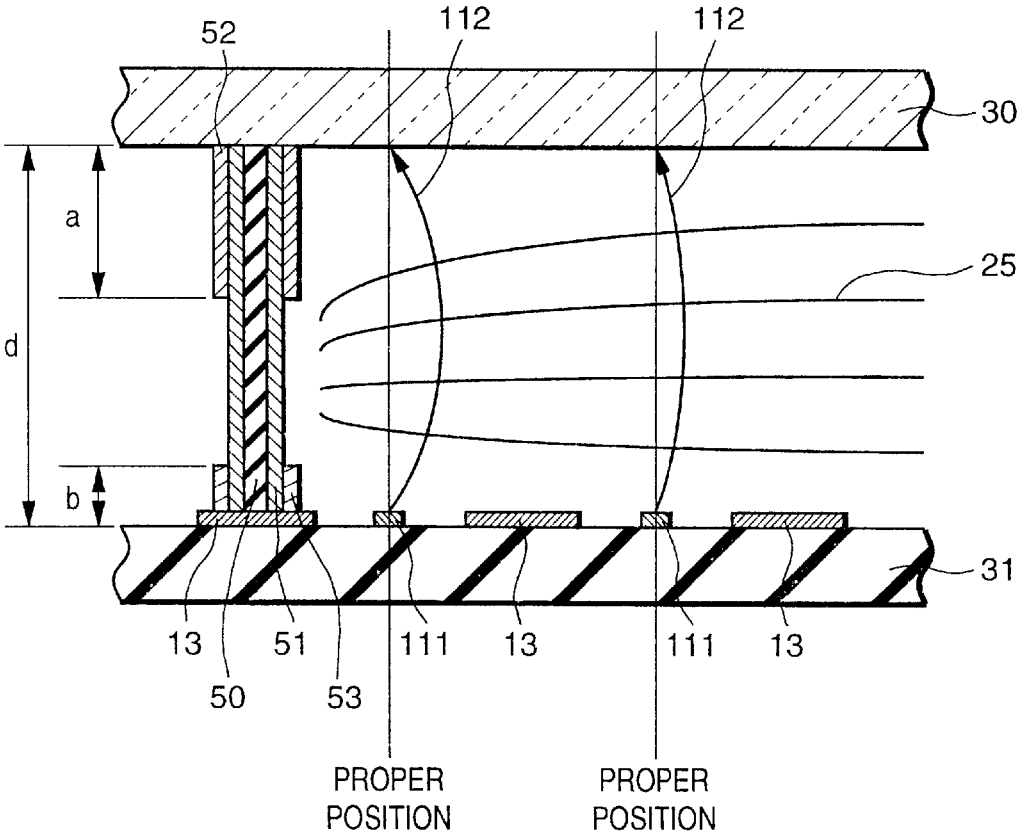
FIG. 1 is a view for explaining the structure of an intermediate layer in an embodiment.

The present invention will be explained in more detail with reference to FIG. 1. Numeral 30 denotes a face plate (face substrate) including fluorescent substances and a metal back; 31, a rear plate (rear substrate) including an electron source substrate; 50, a main body for the spacer; 51, a high-resistance film on the surface of the spacer; 52, an electrode (intermediate layer) on the face plate side; 53, an electrode (intermediate layer) on the rear plate side; and 13, device driving wiring. These parts 50, 51, 52, 53, and 13 constitute a support member (frits (not shown in FIG. 1) are also a constituent element of the support member when the intermediate layer 52 and the face plate 30, and the intermediate layer 53 and the rear plate 31 (i.e., the intermediate layer 53 and the wiring 13) are respectively connected via the frits). Numeral 111 denotes a device 112, typical electron beam orbits; and 25, equipotential lines. Symbol a denotes a length of the third region (length of the region having a resistivity R3) corresponding to the distance from the lower surface of the face plate to the lower end of the intermediate layer 52; and b, a length of the first region (length of the region having a resistivity R1) corresponding to the distance from the upper surface of the rear plate 31 to the upper end of the intermediate layer 53.

If some of electrons emitted near the spacer strike the spacer or ions produced by the action of emitted electrons attach to the spacer due to any reason, the spacer is charged. The orbits of electrons emitted by the devices are changed by the charge-up of the spacer, and the electrons reach positions different from proper positions to distort an image near the spacer. To avoid this, the high-resistance film 51 is formed on the surface of the spacer. As the electron emission amount increases, the charge-up elimination ability becomes poorer, and the landing position of the beam fluctuates depending on the electron emission amount. To prevent this fluctuation, the electrons must be made not to directly strike the spacer. For this purpose, as shown in FIG. 1, the intermediate layer 52 for setting the spacer at the same potential as that of the electron source substrate is formed on the side surface of the spacer in contact with the face plate, and the intermediate layer 53 for setting the spacer at the same potential as that of the electron source substrate is formed on the side surface of the spacer in contact with the electron source substrate. At this time, the potential near the spacer has a distribution indicated by the equipotential lines 25. By this potential distribution, electrons emitted by the devices 111 follow orbits like the orbits 112 to temporarily space apart from the spacer near the rear plate and to be drawn by the spacer near the face plate. Since the electron beam is more accelerated nearer the face plate, the intermediate layer 52 is made longer than the intermediate layer 53, and the potential near the face plate is more steeply changed than that near the rear plate.

Figure 2:
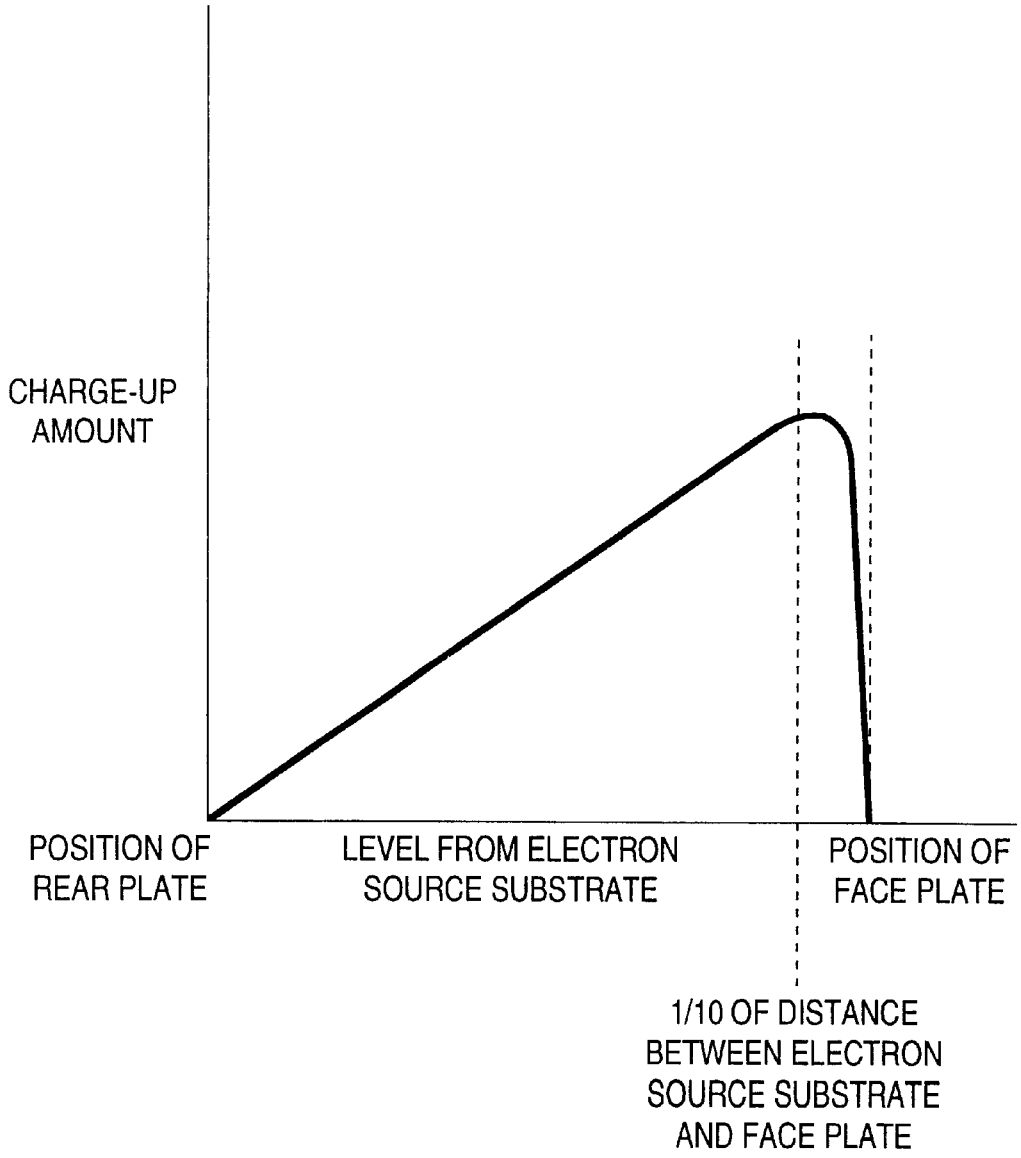
FIG. 2 is a graph showing a model of the charge-up of a spacer.

If the electron emission amount is large even when the electrons emitted by the devices are made not to directly strike the spacer, the spacer is more greatly charged on the face plate side, as show in FIG. 2. The charge-up is the largest at a portion corresponding to 1/10 of the distance between the electron source substrate and the face plate from the face plate toward the rear plate. From this, the intermediate layer 52 on the side surface of the spacer in contact with the face plate is made to have a length equal to or more than 1/10 of the distance between the electron source substrate and the face plate.

Since too long intermediate layers 52 and 53 of the spacer lead a decrease in discharge breakdown voltage and an excess shift of the beam position, the heights of the electrodes of the spacer are set such that the accelerating voltage and the exposure length of the high-resistance film of the spacer have a relationship of 8 kV/mm or less. To further increase the discharge breakdown voltage, the lengths of the electrodes of the spacer are desirably set such that the accelerating voltage and the exposure length of the high-resistance film have a relationship of 4 kV/mm or less.

Figure 3A:
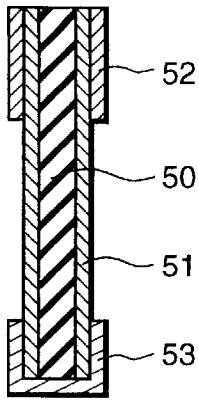
FIGS. 3A–3C show views of combinations of intermediate layers; layers.
Figure 3B:
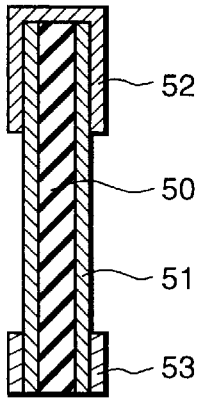
Figure 3C:
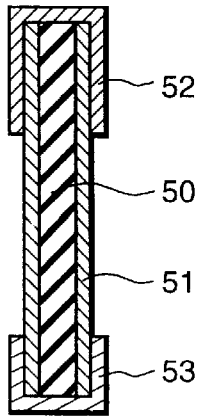
Figure 4:
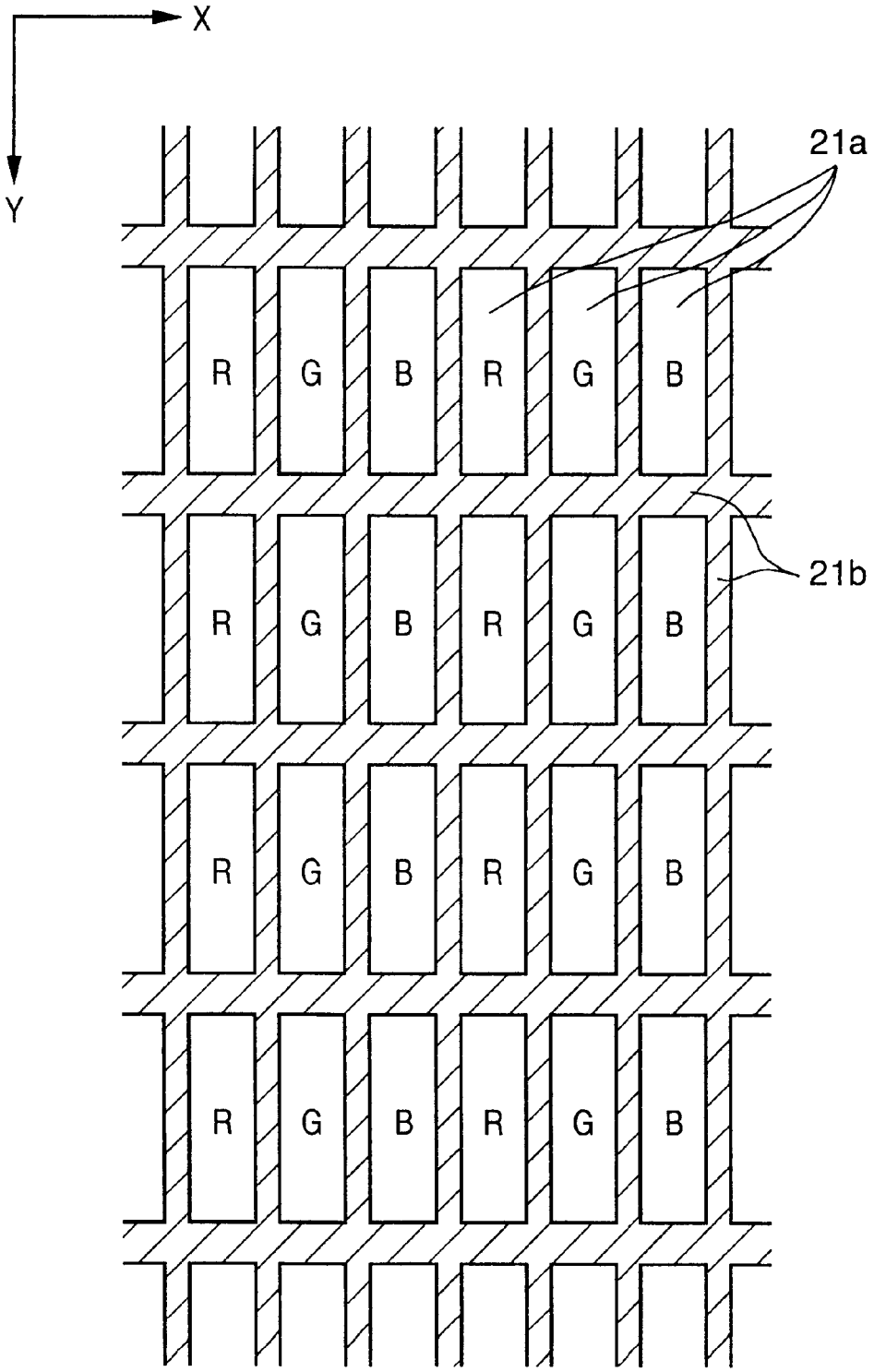
FIG. 4 is a view for explaining an example of the alignment of fluorescent substances in the embodiment.

The intermediate layers may extend to the abutment surface of the spacer against the face plate and/or the abutment surface of the spacer against the electron source substrate, as shown in FIGS. 3A–3C. In this case, the conductive state between the spacer and the face plate and/or the electron source substrate is preferably improved.

Embodiments of the present invention will be described in more detail below.

In each of the following embodiments, a multi electron-beam source is prepared by wiring N×M (N=3,072, M=1,024) SCE type electron-emitting devices each having an electron-emitting portion on a conductive fine particle film between electrodes, by M row-direction wirings and N column-direction wirings in a matrix (see FIGS. 13 and 15).

An appropriate number of spacers are arranged to obtain the atmospheric pressure resistance of the image forming apparatus.

First Embodiment

Figure 18:
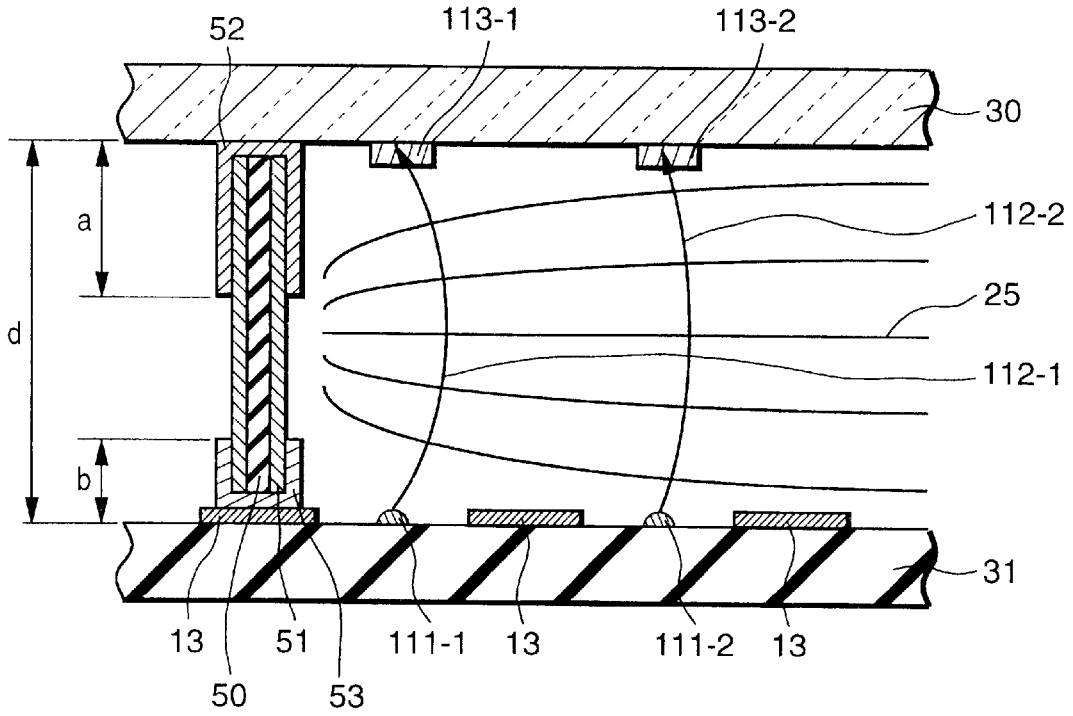
FIG. 18 is a view showing the travel orbit of an electron by the operation of the spacer in the embodiment.
Figure 19:
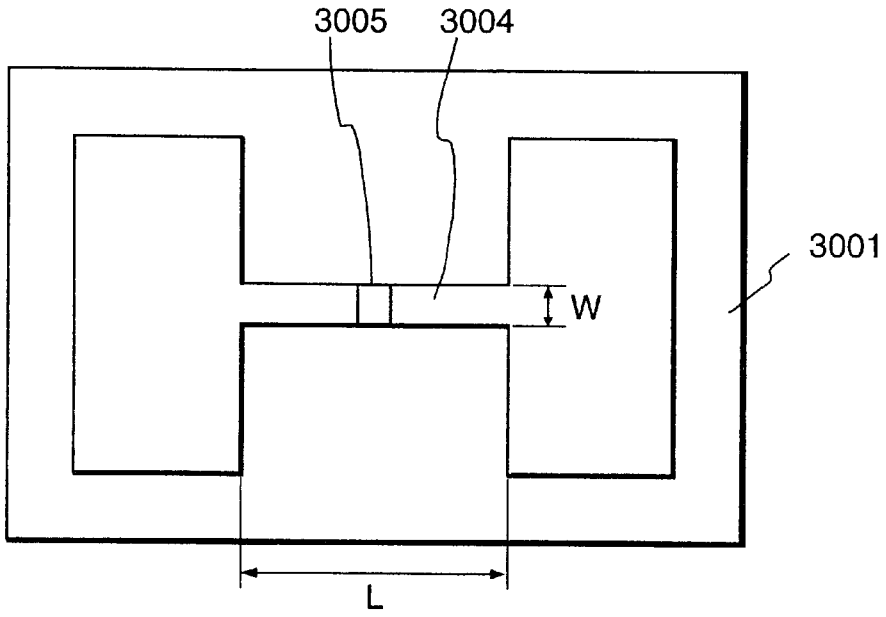
FIG. 19 is a view showing an example of the surface-conduction emission type electron-emitting device.
Figure 20:
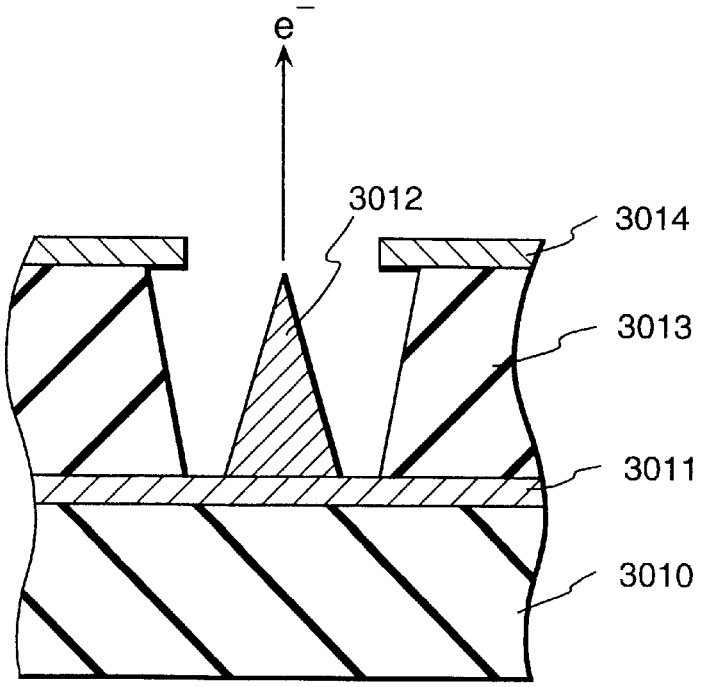
FIG. 20 is a view showing an example of an FE type device.
Figure 21:
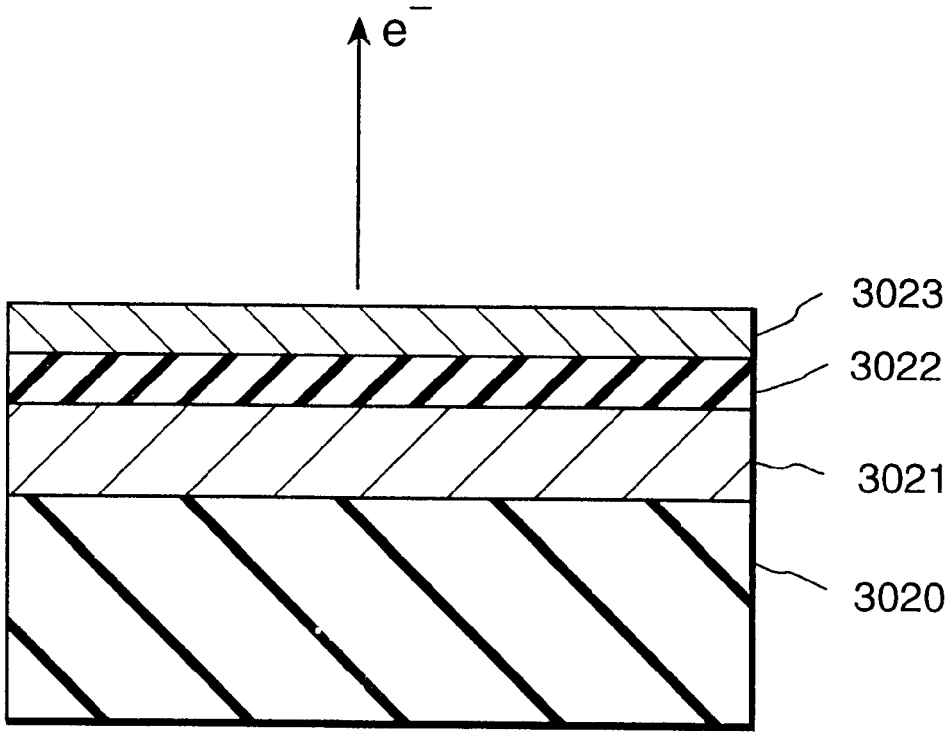
FIG. 21 is a view showing an example of an MIM type device.
Figure 22:
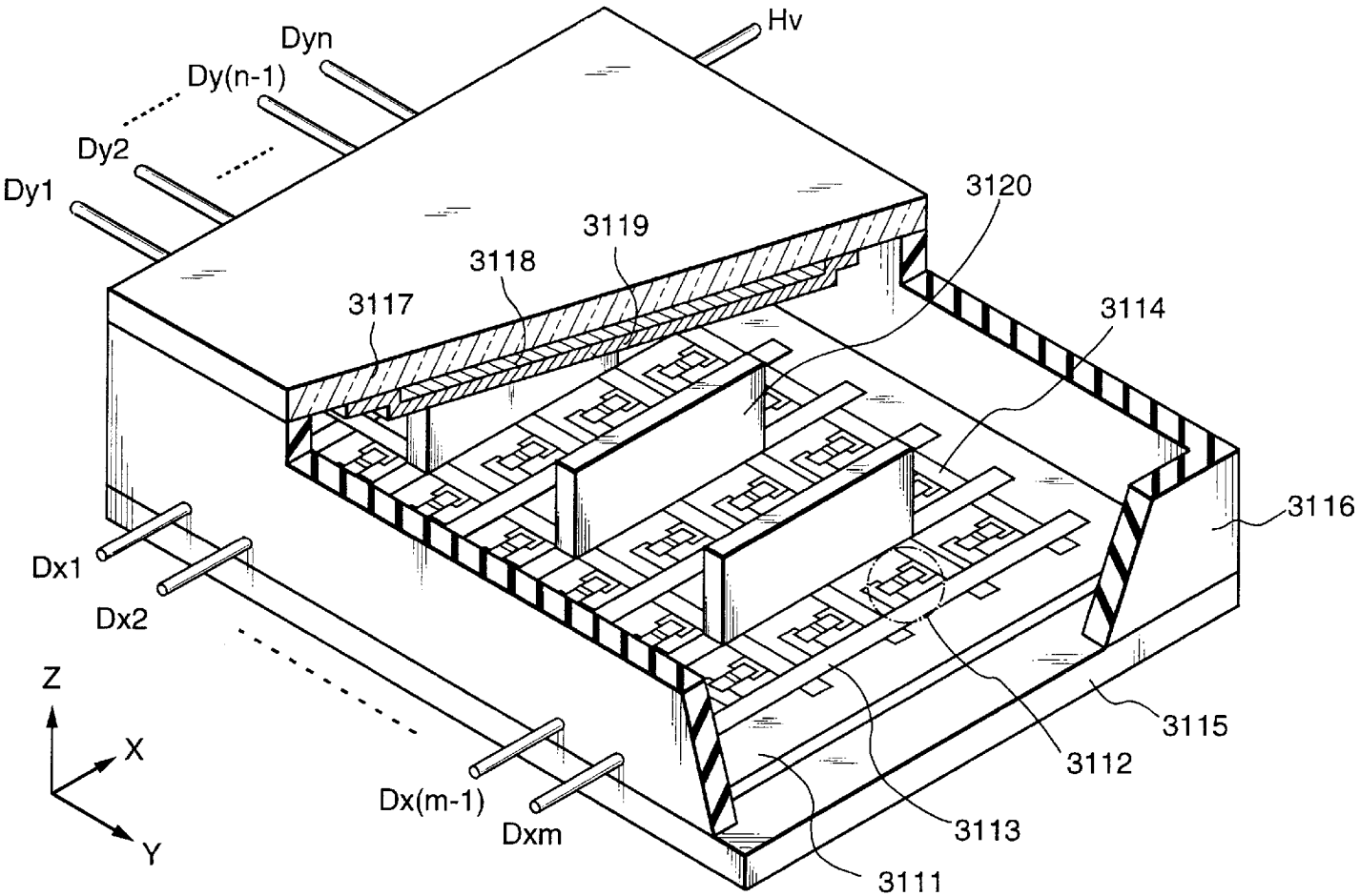
FIG. 22 is a partially cutaway perspective view of the display panel of the image display apparatus.

The first embodiment will be described with reference to FIG. 18. Numeral 30 denotes a face plate including fluorescent substances and a metal back; 31, a rear plate including an electron source substrate; 50, a spacer; 51, a conductive thin film on the surface of the spacer; 52, an intermediate layer on the face plate side; 53, an intermediate layer on the rear plate side; 13, column- or row-direction wiring; 111-1, a device on the nearest column or row to the spacer (to be referred to as the nearest line hereinafter); 111-2, a device on the second nearest column or row to the spacer (to be referred to as the second nearest line hereinafter; the third nearest and subsequent columns or rows will be referred to as the nth nearest lines hereinafter) 112-1, a typical electron beam orbit from the nearest line; 112-2, a typical electron beam orbit from the second nearest line; 113-1 is a range wherein an electron beam from the nearest line fluctuates; 113-2, a range wherein an electron beam from the second nearest line fluctuates; and 25, an equipotential line. Symbol a denotes a length from the lower surface of the face plate to the lower end of the intermediate layer on the face plate side; b, a length from the upper surface of the rear plate to the upper end of the intermediate layer on the rear plate side; and d, a distance between the electron source substrate and the face plate.

The feature of the first embodiment is to use the intermediate layers 52 and 53 not only to establish electrical connection but also to correct the electron beam orbits 112-1 and 112-2 near the spacer. The distance d between the electron source substrate and the face plate is set to 2 mm, and the thickness of the spacer is set to 200 μm. The distance between the outer surface of the spacer and the nearest line is set to 250 μm, and the distance to the second nearest line is set to 950 μm. Lines subsequent to the second nearest line are aligned at an interval of 700 μm. At this time, the resistance of the spacer is set to $10^{10}$ Ω, the length of the intermediate layer on the rear plate side is set to 220 μm, and the length of the intermediate layer on the face plate side is set to 760 μm. When a voltage of 2 kV was applied to the face plate 30 to drive the devices, the position, on the face plate 30, of a beam from the nearest line shifted to the spacer by about 150 μm for the electron emission amount Ie of 3 μA per device, and a positional variation (fluctuation) of about 150 μm was confirmed for Ie of 0.14 to 5.6 μA per device. The position of a beam from the second nearest line shifted to the spacer by about 150 μm, and no positional variation (fluctuation) depended on Ie. These values indicate that the apparatus is improved compared to the conventional apparatus in which the positional variation (fluctuation) depending on Ie is 350 μm for the nearest line and 150 μm for the second nearest line. At this time, no device subsequent to the second nearest line was influenced by the spacer.

Second Embodiment

The second embodiment is different from the first embodiment in that the distance d between an electron source substrate and a face plate is set to 3 mm. In this case, the resistance of the spacer was set on the order of $10^{10}$ Ω, the length of an intermediate layer 53 on the rear plate side was set to 300 μm, and the length of an intermediate layer 52 on the face plate side was set to 1,000 μm. When a voltage of 3 kV was applied to a face plate 30 to drive the devices, the position, on the face plate 30, of a beam from the nearest line shifted to the spacer by about 150 μm for the electron emission amount Ie of 3 μA per device, and a positional variation (fluctuation) of about 150 μm was confirmed for the electron emission amount Ie of 0.14 to 5.6 μA per device. The position of a beam from the second nearest line shifted to the spacer by about 350 μm, and a positional variation (fluctuation) of about 150 μm depending on Ie was confirmed. These values indicate that the apparatus is improved compared to the conventional apparatus in which the positional variation (fluctuation) depending on Ie is about 400 μm.

Third Embodiment

The third embodiment is different from the first embodiment in that the length of an intermediate layer 53 on the rear plate side is set to 300 μm, and the length of an intermediate layer 52 on the face plate side is set to 1,000 μm. As a result, the position of abeam from the nearest line was shifted from the spacer by about 70 μm, and the positional shift (fluctuation) depending on Ie was about 70 μm. The position of a beam from the second nearest line shifted to the spacer by about 70 μm, and no positional variation depending on Ie was confirmed. These values indicate that the apparatus is improved compared to the conventional apparatus in which the position of a beam from the nearest line shifts to the spacer by about 150 μm, the positional variation depending on Ie is 350 μm, the position of a beam from the second nearest line shifts to the spacer by about 150 μm, and the positional variation depending on Ie is 150 μm.

Fourth Embodiment

The fourth embodiment is characterized by forming films having different resistances as upper and lower intermediate layers. In the same structure as that in the first embodiment, a distance h between an electron source substrate and a face plate is set to 2.3 mm.

Figure 23:
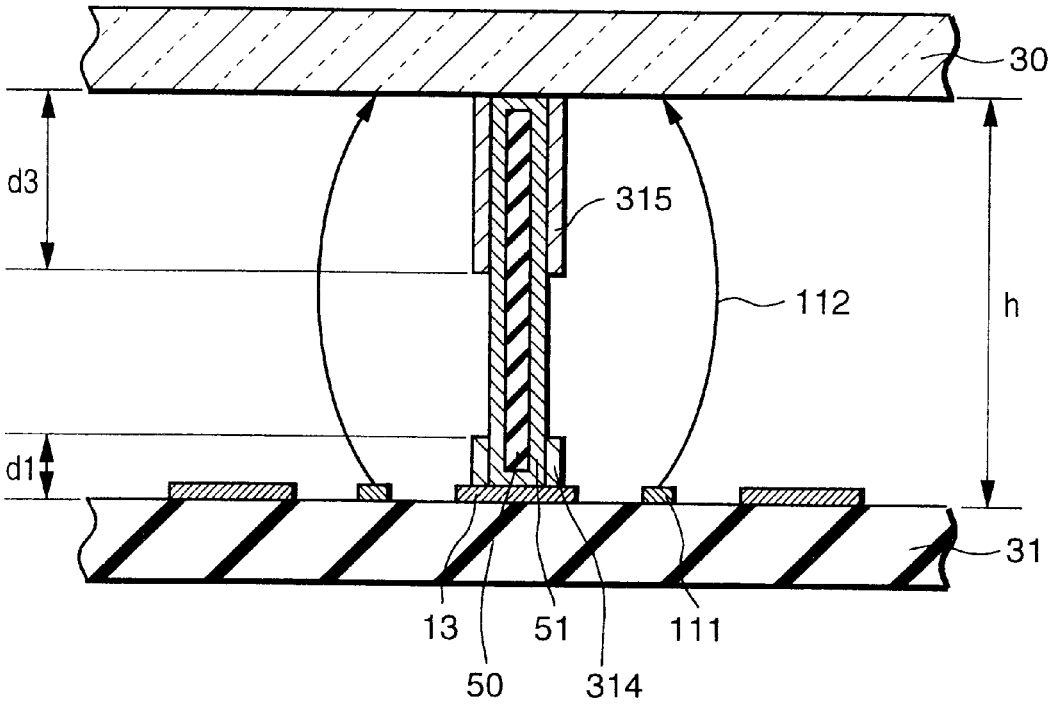
FIG. 23 is a view for explaining the structure of the intermediate layer in the embodiment.

FIG. 23 is a cross-sectional view showing a spacer portion in the fourth embodiment. Numeral 31 denotes a rear plate including an electron source substrate; 30, a face plate including fluorescent substances and a metal back; 50, a spacer; 314, an intermediate layer on the rear plate side; 315, an intermediate layer on the face plate side; 13, wiring; 111, a device; 112, an electron beam orbit; 51, a high-resistance film. In the fourth embodiment, a length d3 of the intermediate layer 314 on the face plate side was set to 1,100 μm, and a length d1 of the intermediate layer 315 on the face plate side was set to 250 μm. The length of each spacer in the wiring direction was set to 50 mm.

In this case, the high-resistance film of the spacer was set to have a resistance of about $5\times10^{9}$ Ω/mm per unit length between the face plate and the rear plate. The intermediate layer 314 on the rear plate side was set to have a resistance of $1\times10^{1}$ Ω/mm or less per unit length, and the intermediate layer 315 on the face plate side was set to have a resistance of about $1\times10^{4}$ Ω/mm per unit length. When a voltage of 5 kV was applied to the face plate 30 to drive the devices, the position, on the face plate 30, of a beam from the nearest line shifted to the spacer by about 120 μm for the electron emission amount Ie of 3 μA per device, and a positional variation (fluctuation) of about 90 μm was confirmed for the electron emission amount Ie of 0.14 to 5.6 μA per device. The position of a beam from the second nearest line shifted to the spacer by about 290 μm, and a positional variation (fluctuation) of about 60 μm depending on Ie was confirmed. From these results, an image forming apparatus in which the positional variation (fluctuation) depending on Ie is small can be provided, similar to the first embodiment.

In the fourth embodiment, the electrode 314 on the rear plate side was formed by sputtering Al in the Ar atmosphere to a thickness of 1,000 A. The intermediate layer on the face plate side was formed by sputtering a tin oxide target in the Ar atmosphere to a thickness of 2,000 A. The high-resistance film 51 was formed by ion beam deposition using NiO to a thickness of 2,000 A. The spacer substrate was made of alumina.

Fifth Embodiment

The fifth embodiment exemplifies the case applying a block-shaped low-resistance member as an intermediate layer member on the rear plate side.

Figure 24:
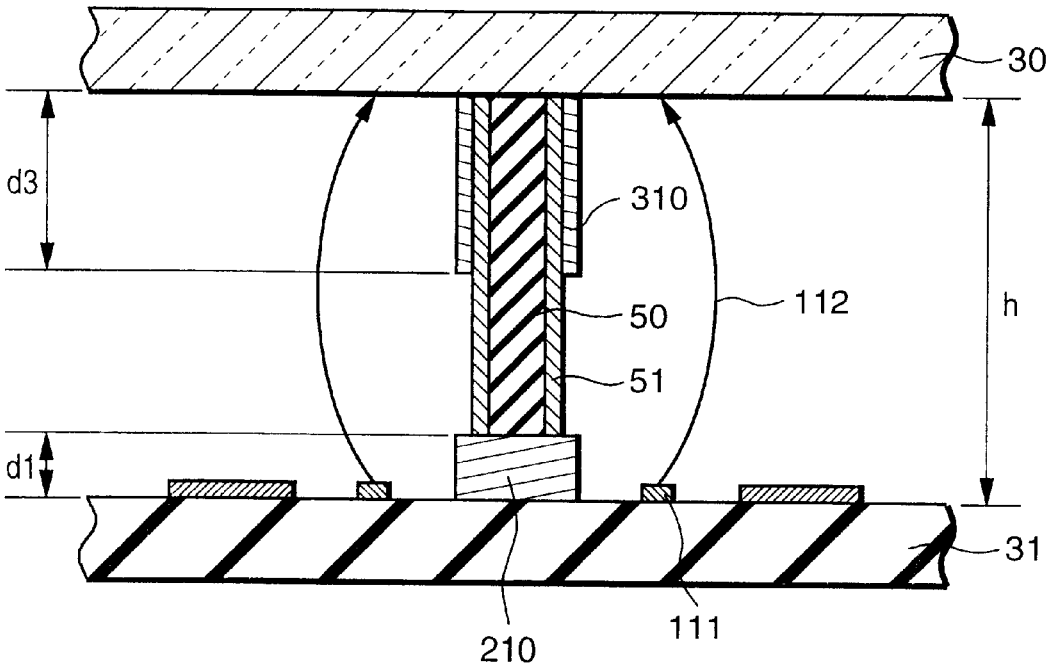
FIG. 24 is a view for explaining another structure of the intermediate layer in the embodiment.

FIG. 24 is a cross-sectional view showing a spacer portion in the fifth embodiment. Numeral 31 denotes a rear plate including an electron source substrate; 30, a face plate including fluorescent substances and a metal back; 20, a spacer; 210, a block-shaped low-resistance member; 13, wiring; 111, a device; 112, an electron beam orbit; and 51, a high-resistance film.

In the fifth embodiment, a length d3 of an intermediate layer 310 on the face plate side was set to 1,100 μm, and a height d1 of the low-resistance member was set to 150 μm.

The length of each spacer in the wiring direction was set to 40 mm. In the fifth embodiment, the block-shaped low-resistance member 210 on the rear plate side also functions as a wiring electrode. In the fifth embodiment, a distance (to be referred to as a panel thickness hereinafter) h between the inner surface of the face plate 30 and the inner surface of the rear plate 31 was set to 2.3 mm. In this case, electrons from a device column (to be referred to as the nearest line hereinafter) spaced apart from the spacer by about 300 μm were made by the block-shaped low-resistance member to follow an orbit in the direction away from the spacer, and then drawn to the spacer by electrode 310 and positive charges on the spacer. As a result, the electrons reached proper positions on the fluorescent substances. At this time, the orbits of electrons emitted by devices on a device line (to be referred to as the second nearest line hereinafter) spaced apart from the spacer by about 1,100 μm, and on subsequent devices were not influenced. Similar to the above embodiments, an image free from distortion and fluctuation could be obtained.

In the fifth embodiment, as the block-like low-resistance member, a 350×300–μm aluminum member was used. However, the low-resistance member can be made of metals such as Ni, Cr, Au, Mo, W, Pt, Ti, Al, Cu, and Pd, and alloys of these metals. In the fifth embodiment as well as the fourth embodiment, the electrode 310 on the face plate side was formed by sputtering Al in the Ar atmosphere to a thickness of 800 A. In the fifth embodiment, the high-resistance film 51 of the spacer was formed of NiO, similar to the fourth embodiment. Each of the intermediate layer 310 on the rear plate side and the low-resistance member 210 on the face plate side had a resistance of about $1\times10^1$ Ω/mm or less per unit length. In the fifth embodiment, the spacer was made of a soda-lime glass.

Sixth Embodiment

The sixth embodiment exemplifies the case applying block-shaped low-resistance members as intermediate layer members on the rear and face plate sides.

Figure 25:
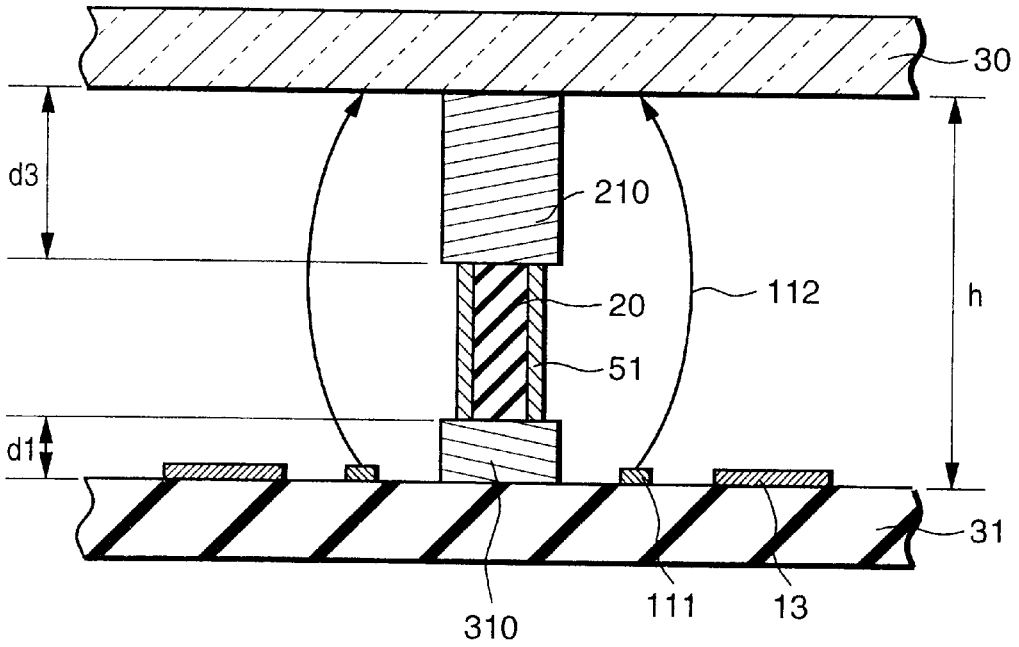
FIG. 25 is a view for explaining still another structure of the intermediate layer in the embodiment.

FIG. 25 is a cross-sectional view showing a spacer portion in the sixth embodiment. The structure in the sixth embodiment is the same as that in the fifth embodiment. Numeral 31 denotes a rear plate including an electron source substrate; 30, a face plate including fluorescent substances and a metal back; 20, a spacer; 210, a block-shaped low-resistance member on the face plate side; 310, a block-shaped low-resistance member on the rear plate side; 13, wiring; 111, a device; 112, an electron beam orbit; and 51, a high-resistance film. A distance (to be referred to as a panel thickness hereinafter) h between the inner surface of the face plate 30 and the inner surface of the rear plate 31 was set to 1.5 mm, a height d3 of the low-resistance member 210 was set to 900 μm, and a height d1 of the low-resistance member 310 was set to 250 μm. In this case, electrons from a device column (to be referred to as the nearest line hereinafter) spaced apart from the spacer by about 300 μm were made by the block-shaped low-resistance member to follow an orbit in the direction away from the spacer, and then drawn to the spacer by the low-resistance block of the spacer on the face plate side and positive charges the high-resistance portion 52 of the spacer. As a result, the electrons reached proper positions on the fluorescent substances. At this time, the orbits of electrons emitted by devices on a device line (to be referred to as the second nearest line hereinafter) spaced apart from the spacer by about 1,100 μm, and on subsequent devices were not influenced. Similar to the above embodiments, an image free from distortion and fluctuation could be obtained.

In the sixth embodiment, a 350×300–μm aluminum member and a 900×300 μm aluminum member were respectively used as the block-like low-resistance members on the rear and face plate sides. However, each low-resistance member can be made of metals such as gold, platinum, rhodium, and copper, and alloys of these metals. Each of the intermediate layer 210 on the rear plate side and the low-resistance member 210 on the face plate side had a resistance of about $1\times10^1$ Ω/mm or less per unit length. In the sixth embodiment, the spacer was made of aluminum nitride.

Seventh Embodiment

The seventh embodiment is directed to a flat field emission (FE) type electron-emitting device used as the electron-emitting device of the present invention.

Figure 26:
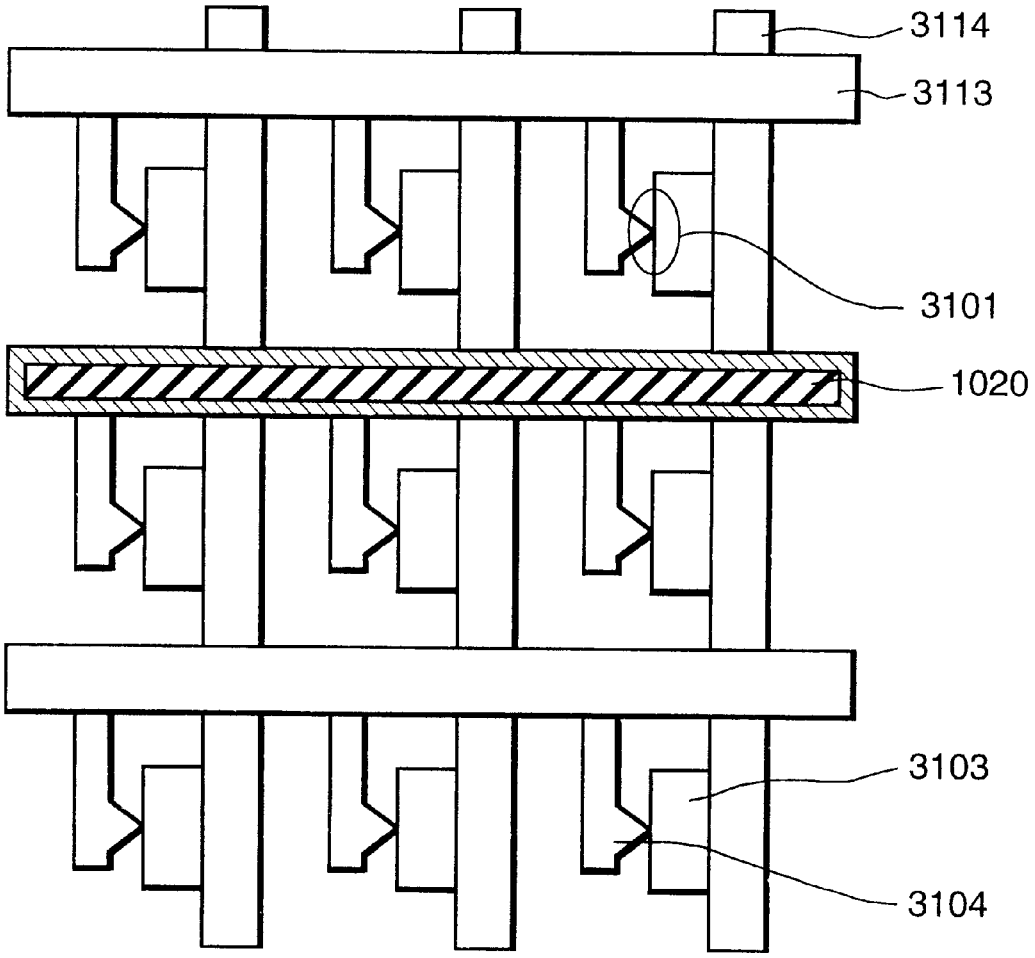
FIG. 26 is a partial plan view of the substrate of the multi electron-beam source used in the embodiment.

FIG. 26 is a plan view of the flat FE type electron-emitting device. Numeral 3101 denotes an electron-emitting portion; 3102 and 3103, a pair of device electrodes for applying a potential to the electron-emitting portion 3101; 3113, row-direction wiring; 3114, column-direction wiring; and 1020, a spacer.

In electron emission, a voltage is applied across the device electrodes 3102 and 3103 to cause a sharp distal end in the electron-emitting portion 3101 to emit electrons. The electrons are drawn by an accelerating voltage (not shown) facing the electron source to collide with a fluorescent substance (not shown), and causes the fluorescent substance to emit light. In the seventh embodiment, an image apparatus was formed by arranging spacers by the same method as in the first embodiment, and driven similarly to the first embodiment to obtain a high-quality image in which a beam shift was suppressed even near the spacer.

Eighth Embodiment

The eighth embodiment is characterized in that films having different resistances are formed as upper and lower intermediate layers, the intermediate layer on the rear plate side is made longer than the intermediate layer on the face plate side.

Figure 27:
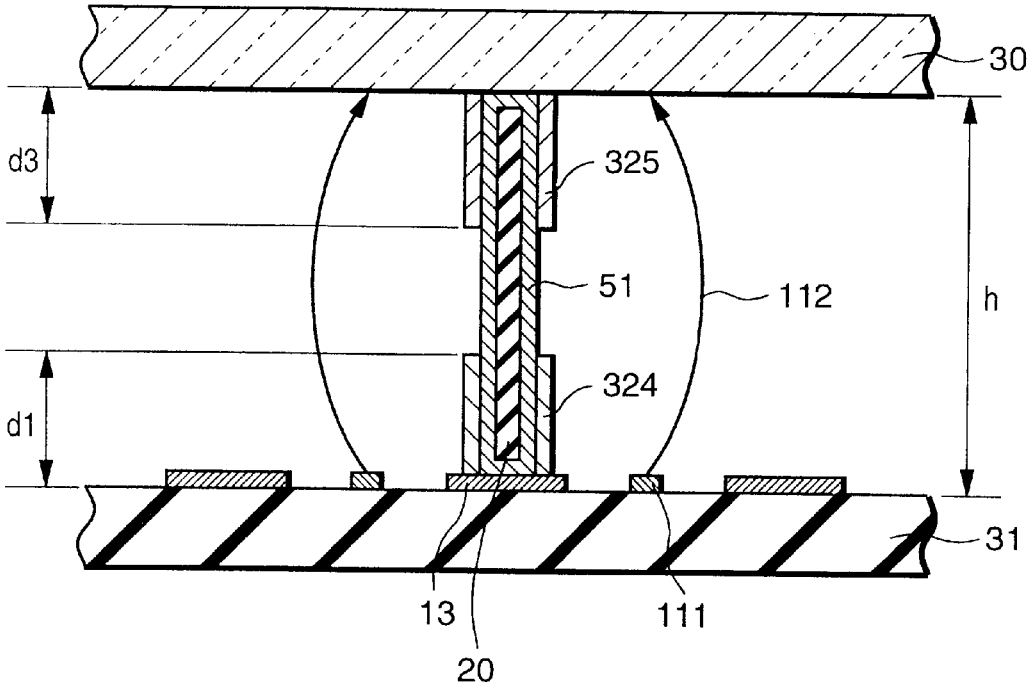
FIG. 27 is a view for explaining still another structure of the intermediate layer in the embodiment.

FIG. 27 is a cross-sectional view of an image forming apparatus near a spacer in the first embodiment for explaining the eighth embodiment. According to the eighth embodiment, in the same structure as that in the first embodiment, a distance h between an electron source substrate and a face plate is set to 3.0 mm.

Referring to FIG. 27, numeral 31 denotes a rear plate including an electron source substrate; 30, a face plate including fluorescent substances and a metal back; 50, a spacer; 324, an intermediate layer on the rear plate side; 325, an intermediate layer on the face plate side; 13, wiring; 111, a device; 112, an electron beam orbit; and 51, a high-resistance film. In the eighth embodiment, a length d3 of the intermediate layer 325 on the face plate side was set to 800 μm, a length d1 of the intermediate layer 324 on the rear plate side was set to 1,100 μm, and the length of each spacer in the wiring direction was set to 80 mm.

In this case, the high-resistance film of the spacer had a resistance of about $6\times10^9$ Ω/mm per unit length between the face plate and the rear plate. The intermediate layer 324 on the rear plate side had a resistance of about $9\times10^8$ Ω/mm per unit length, and the intermediate layer 325 on the face plate side had a resistance of about $1\times10^4$ Ω/mm per unit length. When a voltage of 6.5 kV was applied to the face plate 30 to drive the devices, the position, on the face plate 30, of a beam from the nearest line shifted to the spacer by about 110 μm for the electron emission amount Ie of 3 μA per device, and a positional variation (fluctuation) of about 150 μm was confirmed for the electron emission amount Ie of 0.14 to 5.6 μA per device. The position of a beam from the second nearest line shifted to the spacer by about 300 μm, and a positional variation (fluctuation) of about 70 μm depending on Ie was confirmed. From these results, an image forming apparatus in which the positional variation (fluctuation) depending on Ie is small can be provided, similar to the first embodiment.

In the eighth embodiment, the electrode 325 on the face plate side was formed by sputtering Al in the Ar atmosphere to a thickness of 1,000 A. The electrode 324 on the rear plate side was formed by sputtering a chromium oxide target in the Ar atmosphere to a thickness of 2,000 A. As the high-resistance film 51, nickel oxide was used, and the nickel target was sputtered in the oxygen plasma to a thickness of 1,500 A. The spacer substrate was made of a borosilicate glass.

Even if the intermediate layer on the face plate side is shorter than the intermediate layer on the rear plate side, satisfactory deflection can be applied to electrons as far as a significant difference is set between the resistance of the intermediate layer per unit length on the face plate side and the resistance of the intermediate layer per unit length on the rear plate side, and the resistance of the intermediate layer per unit length on the face plate side is lower.

As has been described above, according to the present invention, preferable deflection can be applied to electrons which are emitted by the electron-emitting devices to reach the member to be irradiated. In particular, electrons can be made to reach positions nearer desired landing positions while the electrons are prevented from striking the support member. Fluctuation of the electron landing position depending on the number of emitted electrons can be reduced. In addition, when the image display apparatus is used as an image forming apparatus, distortion and fluctuation of an image can be reduced.

As many apparently widely different embodiments of the present invention can be made without departing from the spirit and scope thereof, it is to be understood that the invention is not limited to the specific embodiments thereof except as defined in the appended claims.

What is claimed is:

1. An electron apparatus comprising:

a rear substrate having an electron-emitting device;

a front substrate having a member to be irradiated with electrons; and a support member for maintaining an interval between said rear substrate and said front substrate, wherein an electric field for accelerating electrons from said rear substrate toward said front substrate is applied, a surface of said support member has a first region with a length d1 from a portion connected to said rear substrate and a resistance R1 per unit length in a longitudinal direction, a third region with a length d3 from a portion connected to said front substrate and a resistance R3 per unit length in the longitudinal direction, with the third region being extended along an edge connected to the front substance, and a second region which is sandwiched between the first and third regions and has a resistance R2 per unit length in the longitudinal direction, both R1 and R3 are lower than R2, and the lengths and resistances of the first and third regions satisfy at least either one of the following conditions:

a) d1<d3 b) R1>R3.

2. The apparatus according to claim 1, wherein the length d3 of the third region of said support member corresponds to not less than 1/10 of a distance between said front substrate and said rear substrate.

3. The apparatus according to claim 1, wherein a member having a higher conductivity than a conductivity of a surface of the second region is exposed on a surface of the first region.

4. The apparatus according to claim 1, wherein a member having a higher conductivity than a conductivity of a surface of the second region is exposed on a surface of the third region.

5. The apparatus according to claim 1, wherein a surface of the second region is made of a member having a lower conductivity than conductivities of surfaces of the first and third regions.

6. The apparatus according to claim 1, wherein a potential difference between a potential of an end portion of the first region on the second region side and a potential of an end portion of the third region on the second region side, and an interval between the end portion of the first region on the second region side and the end portion of the third region on the second region side have a relationship of not more than 8 kV/mm.

7. The apparatus according to claim 1, wherein a potential difference between a potential of an end portion of the first region on the second region side and a potential of an end portion of the third region on the second region side, and an interval between the end portion of the first region on the second region side and the end portion of the third region on the second region side have a relationship of not more than 4 kV/mm.

8. The apparatus according to claim 1, wherein a main body of said support member is connected to said rear substrate or said front substrate via wiring or an electrode.

9. The apparatus according to claim 1, wherein said electron-emitting device is a cold cathode type electron-emitting device.

10. The apparatus according to claim 1, wherein said electron-emitting device is a surface-conduction emission type electron-emitting device.

11. An electron apparatus comprising:

a rear substrate having an electron-emitting device;

a front substrate having a member to be irradiated with electrons; and a support member for maintaining an interval between said rear substrate and said front substrate, wherein an electric field for accelerating electrons from said rear substrate toward said front substrate is applied, a surface of said support member has a first region with a length d1 from a portion connected to said rear substrate, a third region with a length d3 from a portion connected to said front substrate, the third region being extended along an edge connected to the front substrate and a second region sandwiched between the first and third regions, potential differences per unit length in a longitudinal direction on the surface of said support member in the first and third regions are smaller than a potential difference per unit length in the longitudinal direction on the surface of said support member in the second region, and letting ΔV1 be a potential difference between a potential of a portion connected to said rear substrate and a potential of an end portion of the first region on the second region side, and ΔV3 be a potential different between a potential of a portion connected to said front substrate and a potential of an end portion of the third region on the second region side, the potential differences satisfy:

ΔV1/d1>ΔV3/d3.

12. The apparatus according to claim 11, wherein the length d3 of the third region of said support member corresponds to not less than 1/10 of a distance between said front substrate and said rear substrate.

13. The apparatus according to claim 11, wherein a member having a higher conductivity than a conductivity of a surface of the second region is exposed on a surface of the first region.

14. The apparatus according to claim 11, wherein a member having a higher conductivity than a conductivity of a surface of the second region is exposed on a surface of the third region.

15. The apparatus according to claim 11, wherein a surface of the second region is made of a member having a lower conductivity than conductivities of surfaces of the first and third regions.

16. The apparatus according to claim 11, wherein a potential difference between a potential of an end portion of the first region on the second region side and a potential of an end portion of the third region on the second region side, and an interval between the end portion of the first region on the second region side and the end portion of the third region on the second region side have a relationship of not more than 8 kV/mm.

17. The apparatus according to claim 11, wherein a potential difference between a potential of an end portion of the first region on the second region side and a potential of an end portion of the third region on the second region side, and an interval between the end portion of the first region on the second region side and the end portion of the third region on the second region side have a relationship of not more than 4 kV/mm.

18. The apparatus according to claim 11, wherein a main body of said support member is connected to said rear substrate or said front substrate via wiring or an electrode.

19. The apparatus according to claim 11, wherein said electron-emitting device is a cold cathode type electron-emitting device.

20. The apparatus according to claim 11, wherein said electron-emitting device is a surface-conduction emission type electron-emitting device.

21. An image forming apparatus comprising:

said electron apparatus as defined in claim 1, wherein an image is formed on said member to be irradiated with electrons.

22. An image forming apparatus comprising:

said electron apparatus as defined in claim 1 wherein said member to be irradiated with electrons has a light-emitting substance which emits light upon irradiation of electrons.

23. An image forming apparatus comprising:

said electron apparatus as defined in claim 1 , wherein said member to be irradiated with electrons has a fluorescent substance which emits light upon irradiation of electrons.

24. An electron apparatus comprising:

a rear substrate having an electron-emitting device;

a front substrate having a member to be irradiated with electrons; and a support member for maintaining an interval between said rear substrate and said front substrate, wherein an electric field for accelerating electrons from said rear substrate toward said front substrate is applied, a surface of said support member has a first region with a length d1 from a portion connected to said rear substrate and a resistance R1 per unit length in a longitudinal direction, a third region with a length d3 from a portion connected to said front substrate and a resistance R3 per unit length in the longitudinal direction, and a second region which is sandwiched between the first and third regions and has a resistance R2 per unit length in the longitudinal direction, both R1 and R3 are lower than R2, and the third region is electrically connected to an accelerating electrode provided on said front substrate, and the length of the first and third regions satisfy the following condition: $d1<d3$.

25. An electron apparatus comprising:

a rear substrate having an electron-emitting device;

a front substrate having a member to be irradiated with electrons; and a support member for maintaining an interval between said rear substrate and said front substrate, wherein an electric field for accelerating electrons from said rear substrate toward said front substrate is applied, a surface of said support member has a first region with a length d1 from a portion connected to said rear substrate and a resistance R1 per unit length in a longitudinal direction, a third region with a length d3 from a portion connected to said front substrate and a resistance R3 per unit length in the longitudinal direction, and a second region which is sandwiched between the first and third regions and has a resistance R2 per unit length in the longitudinal direction, both R1 and R3 are lower than R2, and the third region is electrically connected to an accelerating electrode provided on said front substrate, and the resistances of the first and third regions satisfy the following condition: $R1>R3$.

26. The apparatus according to claim 11, wherein the third region is electrically provided on said first substrate.

27. An electron apparatus comprising:

a rear substrate having an electron-emitting device;

a front substrate having a member to be irradiated with electrons; and a support member for maintaining an interval between said rear substrate and said front substrate, wherein an electric field for accelerating electrons from said rear substrate toward said front substrate is applied, a surface of said support member has a first region with a length d1 from a portion connected to said rear substrate and a resistance R1 per unit length in a longitudinal direction, a third region with a length d3 from a portion connected to said front substrate and a resistance R3 per unit length in the longitudinal direction, and a second region which is sandwiched between the first and third regions and has a resistance R2 per unit length in the longitudinal direction, both R1 and R3 are lower than R2, and the third region is provided in an electrified area of said support member, and the length of the first and third regions satisfy the following condition: $d1<d3$.

28. An electron apparatus comprising:

a rear substrate having an electron-emitting device;

a front substrate having a member to be irradiated with electrons; and a support member for maintaining an interval between said rear substrate and said front substrate, wherein an electric field for accelerating electrons from said rear substrate toward said front substrate is applied, a surface of said support member has a first region with a length d1 from a portion connected to said rear substrate and a resistance R1 per unit length in a longitudinal direction, a third region with a length d3 from a portion connected to said front substrate and a resistance R3 per unit length in the longitudinal direction, and a second region which is sandwiched between the first and third regions and has a resistance R2 per unit length in the longitudinal direction, both R1 and R3 are lower than R2, and the third region is provided in an electrified area of said support member, and the resistances of the first and third regions satisfy the following condition:

R1>R3.

29. The apparatus according to claim 11, wherein the third region is provided in an electrified area of said support member.

30. An electron apparatus comprising:

a rear substrate having an electron-emitting device;

a front substrate having a member to be irradiated with electrons; and a support member for maintaining an interval between said rear substrate and said front substrate, wherein an electric field for accelerating electrons from said rear substrate toward said front substrate is applied, a surface of said support member has a first region with a length d1 from a portion connected to said rear substrate and a resistance R1 per unit length in a longitudinal direction, a third region with a length d3 from a portion connected to said front substrate and a resistance R3 per unit length in the longitudinal direction, and a second region which is sandwiched between the first and third regions and has a resistance R2 per unit length in the longitudinal direction, both R1 and R3 are lower than R2, and the third region is provided on both sides of said support member, and the length of the first and third regions satisfy the following condition:

d1<d3.

31. An electron apparatus comprising:

a rear substrate having an electron-emitting device;

a front substrate having a member to be irradiated with electrons; and a support member for maintaining an interval between said rear substrate and said front substrate, wherein an electric field for accelerating electrons from said rear substrate toward said front substrate is applied, a surface of said support member has a first region with a length d1 from a portion connected to said rear substrate and a resistance R1 per unit length in a longitudinal direction, a third region with a length d3 from a portion connected to said front substrate and a resistance R3 per unit length in the longitudinal direction, and a second region which is sandwiched between the first and third regions and has a resistance R2 per unit length in the longitudinal direction, both R1 and R3 are lower than R2, and the third region is provided on both sides of said support member, and the resistances of the first and third regions satisfy the following condition:

R1>R3.

32. The apparatus according to claim 11, wherein the third region is provided on both sides of said support member.

* * * * *

UNITED STATES PATENT AND TRADEMARK OFFICE

CERTIFICATE OF CORRECTION

PATENT NO. : 6,184,619 B1
DATED : February 6, 2001
INVENTOR(S) : Koji Yamazaki et al.

It is certified that error appears in the above-identified patent and that said Letters Patent is hereby corrected as shown below:

Column 4,
Line 47, "of" should be deleted.
Line 49, "of" should read -- of the --.

Column 8,
Line 53, "$\hat{1}$" should read --①--.
Line 57, "$\hat{2}$" should read --②--.
Line 61, "$\hat{3}$" should read --③--.

Column 9,
Line 4, "$\hat{4}$" should read --④--.

Column 12,
Line 34, "the surfaces, of" should read -- on --.

Column 14,
Line 21, "$\hat{1}$" should read --①--.
Line 38, "$\hat{2}$" should read --②--.
Line 61, "$\hat{3}$" should read --③--.

Column 15,
Line 52, "to cause" should read -- and cause --.
Line 53, "collide" should read -- to collide --.

Column 27,
Line 60, "abeam" should read -- a beam --.

Column 32,
Line 53, "substrate" should read -- substrate, --.
Line 63, "different" should read -- difference --.

UNITED STATES PATENT AND TRADEMARK OFFICE

CERTIFICATE OF CORRECTION

PATENT NO. : 6,184,619 B1
DATED : February 6, 2001
INVENTOR(S) : Koji Yamazaki et al.

It is certified that error appears in the above-identified patent and that said Letters Patent is hereby corrected as shown below:

Column 33,
Line 48, "claim 1" should read -- claim 1, --.

Signed and Sealed this

Twelfth Day of February, 2002

*Attest:*

*Attesting Officer*

JAMES E. ROGAN
*Director of the United States Patent and Trademark Office*